US007698055B2

(12) United States Patent
Horvitz et al.

(10) Patent No.: US 7,698,055 B2
(45) Date of Patent: Apr. 13, 2010

(54) TRAFFIC FORECASTING EMPLOYING MODELING AND ANALYSIS OF PROBABILISTIC INTERDEPENDENCIES AND CONTEXTUAL DATA

(75) Inventors: Eric J. Horvitz, Kirkland, WA (US); Johnson T. Apacible, Mercer Island, WA (US); Raman K. Sarin, Redmond, WA (US)

(73) Assignee: Microsoft Corporation, Redmond, WA (US)

( * ) Notice: Subject to any disclaimer, the term of this patent is extended or adjusted under 35 U.S.C. 154(b) by 1204 days.

(21) Appl. No.: 11/171,791

(22) Filed: Jun. 30, 2005

(65) Prior Publication Data

US 2006/0106530 A1 May 18, 2006

Related U.S. Application Data

(60) Provisional application No. 60/628,267, filed on Nov. 16, 2004.

(51) Int. Cl.
*G06G 7/76* (2006.01)

(52) U.S. Cl. ..... 701/117; 342/357.07

(58) Field of Classification Search ..... 701/117–119, 701/201, 202, 207–209, 211; 342/357.13, 342/357.07; 340/988–990, 995.1, 995.13, 340/995.18, 539.13
See application file for complete search history.

(56) References Cited

U.S. PATENT DOCUMENTS 5,375,059 A 12/1994 Kyrtsos et al.
5,493,692 A 2/1996 Theimer et al.
5,541,590 A 7/1996 Nishio
5,544,321 A 8/1996 Theimer et al.
5,555,376 A 9/1996 Theimer et al.
5,603,054 A 2/1997 Theimer et al.
5,611,050 A 3/1997 Theimer et al.
5,751,245 A 5/1998 Janky et al.

(Continued)

FOREIGN PATENT DOCUMENTS

DE 10057796 A1 5/2002

(Continued)

OTHER PUBLICATIONS

International Search Report dated Jan. 11, 2007 for International Patent Application No. PCT/US 06/25167, 3 pgs.

(Continued)

*Primary Examiner*—Dalena Tran
(74) *Attorney, Agent, or Firm*—Wolf, Greenfield & Sacks, P.C.

(57) ABSTRACT

Systems and methods are described for constructing predictive models, based on statistical machine learning, that can make forecasts about traffic flows and congestions, based on an abstraction of a traffic system into a set of random variables, including variables that represent the amount of time until there will be congestion at key troublespots and the time until congestions will resolve. Observational data includes traffic flows and dynamics, and other contextual data such as the time of day and day of week, holidays, school status, the timing and nature of major gatherings such as sporting events, weather reports, traffic incident reports, and construction and closure reports. The forecasting methods are used in alerting, the display graphical information about predictions about congestion on desktop on mobile devices, and in offline and real-time automated route recommendations and planning.

20 Claims, 31 Drawing Sheets

U.S. PATENT DOCUMENTS 5,812,865 A 9/1998 Theimer et al.
5,945,985 A 8/1999 Babin et al.
6,256,577 B1 * 7/2001 Graunke ..... 701/117
6,317,686 B1 * 11/2001 Ran ..... 701/210
6,321,158 B1 11/2001 DeLorme et al.
6,353,398 B1 3/2002 Amin et al.
6,360,168 B1 3/2002 Shimabara
6,466,232 B1 10/2002 Newell et al.
6,513,046 B1 1/2003 Abbott, III et al.
6,549,915 B2 4/2003 Abbott, III et al.
6,672,506 B2 1/2004 Swartz et al.
6,735,549 B2 5/2004 Ridolfo
6,741,188 B1 5/2004 Miller et al.
6,747,675 B1 6/2004 Abbott et al.
D494,584 S 8/2004 Schlieffers et al.
6,785,606 B2 * 8/2004 DeKock et al. ..... 701/117
6,791,580 B1 9/2004 Abbott et al.
6,796,505 B2 9/2004 Pellaumail et al.
6,801,223 B1 10/2004 Abbott et al.
6,812,937 B1 11/2004 Abbott et al.
6,813,555 B1 * 11/2004 Kerner ..... 701/117
6,837,436 B2 1/2005 Swartz et al.
6,842,877 B2 1/2005 Robarts et al.
6,879,969 B2 4/2005 Engstrom et al.
6,938,203 B1 8/2005 Dimarco et al.
7,006,866 B1 2/2006 Deco et al.
7,010,501 B1 3/2006 Roslak et al.
7,012,614 B2 3/2006 Chalfin et al.
7,040,541 B2 5/2006 Swartz et al.
7,063,263 B2 6/2006 Swartz et al.
7,069,258 B1 6/2006 Bothwell
7,098,805 B2 * 8/2006 Meadows et al. ..... 340/905
7,103,470 B2 9/2006 Mintz
7,149,716 B2 12/2006 Gatto
7,171,378 B2 1/2007 Petrovich et al.
7,195,157 B2 3/2007 Swartz et al.
7,317,449 B2 1/2008 Robbins et al.
7,385,501 B2 6/2008 Miller et al.
7,610,560 B2 10/2009 Horvitz et al.
2001/0030664 A1 10/2001 Shulman et al.
2001/0040590 A1 11/2001 Abbott et al.
2001/0040591 A1 11/2001 Abbott et al.
2001/0043231 A1 11/2001 Abbott et al.
2001/0043232 A1 11/2001 Abbott et al.
2002/0026278 A1 2/2002 Feldman et al.
2002/0032689 A1 3/2002 Abbott, III et al.
2002/0044152 A1 4/2002 Abbott, III et al.
2002/0052930 A1 5/2002 Abbott et al.
2002/0052963 A1 5/2002 Abbott et al.
2002/0054130 A1 5/2002 Abbott, III et al.
2002/0054174 A1 5/2002 Abbott et al.
2002/0078204 A1 6/2002 Newell et al.
2002/0080155 A1 6/2002 Abbott et al.
2002/0080156 A1 6/2002 Abbott et al.
2002/0083025 A1 6/2002 Robarts et al.
2002/0083158 A1 6/2002 Abbott et al.
2002/0087525 A1 7/2002 Abbott et al.
2002/0099817 A1 7/2002 Abbott et al.
2003/0009270 A1 1/2003 Breed
2003/0046401 A1 3/2003 Abbott et al.
2003/0069683 A1 4/2003 Lapidot et al.
2003/0154476 A1 8/2003 Abbott, III et al.
2004/0098194 A1 5/2004 Baur et al.
2004/0122702 A1 6/2004 Sabol et al.
2004/0201500 A1 10/2004 Miller et al.
2004/0257440 A1 12/2004 Kondo et al.
2005/0034078 A1 2/2005 Abbott et al.
2005/0065711 A1 3/2005 Dahlgren et al.
2005/0090938 A1 4/2005 Ranelli
2005/0108322 A1 5/2005 Kline et al.
2005/0266858 A1 12/2005 Miller et al.
2005/0272442 A1 12/2005 Miller et al.
2006/0019676 A1 1/2006 Miller et al.
2006/0089787 A1 4/2006 Burr et al.
2006/0103674 A1 5/2006 Horvitz et al.
2006/0106599 A1 5/2006 Horvitz
2008/0090591 A1 4/2008 Miller et al.
2008/0091537 A1 4/2008 Miller et al.
2008/0161018 A1 7/2008 Miller et al.

FOREIGN PATENT DOCUMENTS

DE 10063763 A1 7/2002
DE 10110549 A1 9/2002
DE 102004015880 A1 11/2004
DE 10336590 A1 2/2005
WO 9800787 1/1998

OTHER PUBLICATIONS

T. Joachims, Text categorization with support vector machines: learning with many relevant features, Machine Learning, European Conference on Machine Learning, Apr. 21, 1998, pp. 137-142.
International Search dated Sep. 29, 2003 for PCT Application Serial No. 00/20685, 3 Pages.
Robert M. Losee, Jr., Minimizing information overload: the ranking of electronic messages, Journal of Information Science 15, Elsevier Science Publishers B.V., 1989, pp. 179-189.
Pawan Lingras, et al. "Traffic Volume Time-Series Analysis According to the Type of Road Use" Computer-Aided Civil and Infrastructure Engineering, Blackwell Publishers, 350 Main Street, Malden, MA 02148, 9 pages.
European Search Report dated Apr. 26, 2007 for European Patent Application Serial No. 05 10 9793, 2 Pages.
Andy Harter, et al., A Distributed Location System for the Active Office, IEEE Network, 1994, pp. 62-70.
Guanling Chen, et al., A Survey of Context-Aware Mobile Computing Research, Dartmouth Computer Science Technical Report, 2000, 16 pages.
William Noah Schilt, A System Architecture for Context-Aware Mobile Computing, Columbia University, 1995, 153 pages.
Mike Spreitzer, et al., Providing Location Information in a Ubiquitous Computing Environment, SIGOPS '93, 1993, pp. 270-283.
Marvin Theimer, et al., Operating System Issues for PDAs, In Fourth Workshop on Workstation Operating Systems, 1993, 7 pages.
Roy Want, Active Badges and Personal Interactive Computing Objects, IEEE Transactions on Consumer Electronics, 1992, 11 pages, vol. 38—No. 1.
Bill N. Schilit, et al., The ParcTab Mobile Computing System, IEEE WWOS-IV, 1993, 4 pages.
Bill Schilit, et al., Context-Aware Computing Applications, In Proceedings of the Workshop on Mobile Computing Systems and Applications, Dec. 1994. pp. 85-90.
Bill N. Schilit, et al., Customizing Mobile Applications, Proceedings USENIX Symposium on Mobile and Location Independent Computing, Aug. 1993, 9 pages.
Mike Spreitzer, et al., Architectural Considerations for Scalable, Secure, Mobile Computing with Location Information, In the 14th International Conference on Distributed Computing Systems, Jun. 1994, pp. 29-38.
Mike Spreitzer et al., Scalable, Secure, Mobile Computing with Location Information, Communications of the ACM, Jul. 1993, 1 page, vol. 36—No. 7.
Roy Want, et al., The Active Badge Location System, ACM Transactions on Information Systems, Jan. 1992, pp. 91-102, vol. 10—No. 1.
Mark Weiser, Some Computer Science Issues in Ubiquitous Computing, Communications of the ACM, Jul. 1993, pp. 75-84, vol. 36—No. 7.
M. Billinghurst, et al., An Evaluation of Wearable Information Spaces, Proceedings of the Virtual Reality Annual International Symposium, 1998, 8 pages.

Bradley J. Rhodes, Remembrance Agent: A continuously running automated information retrieval system, The Proceedings of The First International Conference on The Practical Application Of Intelligent Agents and Multi Agent Technology, 1996, pp. 487-495.

Eric Horvitz, et al., In Pursuit of Effective Handsfree Decision Support: Coupling Bayesian Inference, Speech Understanding, and User Models, 1995, 8 pages.

Bradley J. Rhodes, The Wearable Remembrance Agent: A System for Augmented Theory, The Proceedings of The First International Symposium on Wearable Computers, Oct. 1997, pp. 123-128.

Eric Horvitz, et al., Attention-Sensitive Alerting in Computing Systems, Microsoft Research, Aug. 1999.

Bill N. Schilit, et al., Disseminationg Active Map Information to Mobile Hosts, IEEE Network, 1994, pp. 22-32, vol. 8—No. 5.

Mark Billinghurst, et al., Wearable Devices: New Ways to Manage Information, IEEE Computer Society, Jan. 1999, pp. 57-64.

Thad Eugene Starner, Wearable Computing and Contextual Awareness, Massachusetts Institute of Technology, Jun. 1999, 248 pages.

Bradley J. Rhodes, The Wearable Remembrance Agent: A System for Augmented Memory, Personal Technologies Journal Special Issue on Wearable Computing, 1997, 12 pages.

Mark Weiser, The Computer for the 21st Century, Scientific American, Sep. 1991, 8 pages.

S.D. Bay, et al. (1999). Detecting Change in Categorical Data: Mining Contrast Sets. Knowledge Discovery and Data Mining, pp. 302-499.

D.M. Chickering, et al. (1997). A Bayesian approach to learning Bayesian networks with local structure. In Proceedings of Thirteenth Conference on Uncertainty in Artificial Intelligence, 80-89.

E. Horvitz, et al. (1995) Display of Information for Time-Critical Decision Making. Proceedings of the Eleventh Conference on Uncertainty in Artificial Intelligence. Morgan Kaufmann Publishers, 296-305.

M. Meek, et al. (2002). Staged Mixture Modeling and Boosting. Proceedings of the UAI 2002, pp. 335-343.

U. Nodelman, et al. Continuous Time Bayesian Networks for Inferring Users' Presence and Activities with Extensions for Modeling and Evaluation, Microsoft Research Technical Report MSR-TR-2003-97, Dec. 2003.

U. Nodelman, et al. (2003). Learning Continuous Time Bayesian Networks. Proceedings of UAI 2003, pp. 451-458.

D. Robbins, et al. (2004). ZoneZoom: Map Navigation with Smartphones with Recursive View Segmentation, Advanced Visual Interfaces, AVI 2004, Gallipoli, Italy, May 2004.

N. Vandaele, et al. (2000). A Queuing-Based Traffic Flow Model. Transportation Research-D: Transportation and Environment, 5(2), pp. 121-135.

W. Wong, et al. (2003). Bayesian Network Anomaly Pattern Detection for Disease Outbreaks. ICML 2003: 808-815.

Office Action dated Oct. 3, 2008 for U.S. Appl. No. 11/165,070, 11 pages.

Office Action dated Aug. 13, 2008 for U.S. Appl. No. 11/172,581, 33 pages.

* cited by examiner

2200

2400

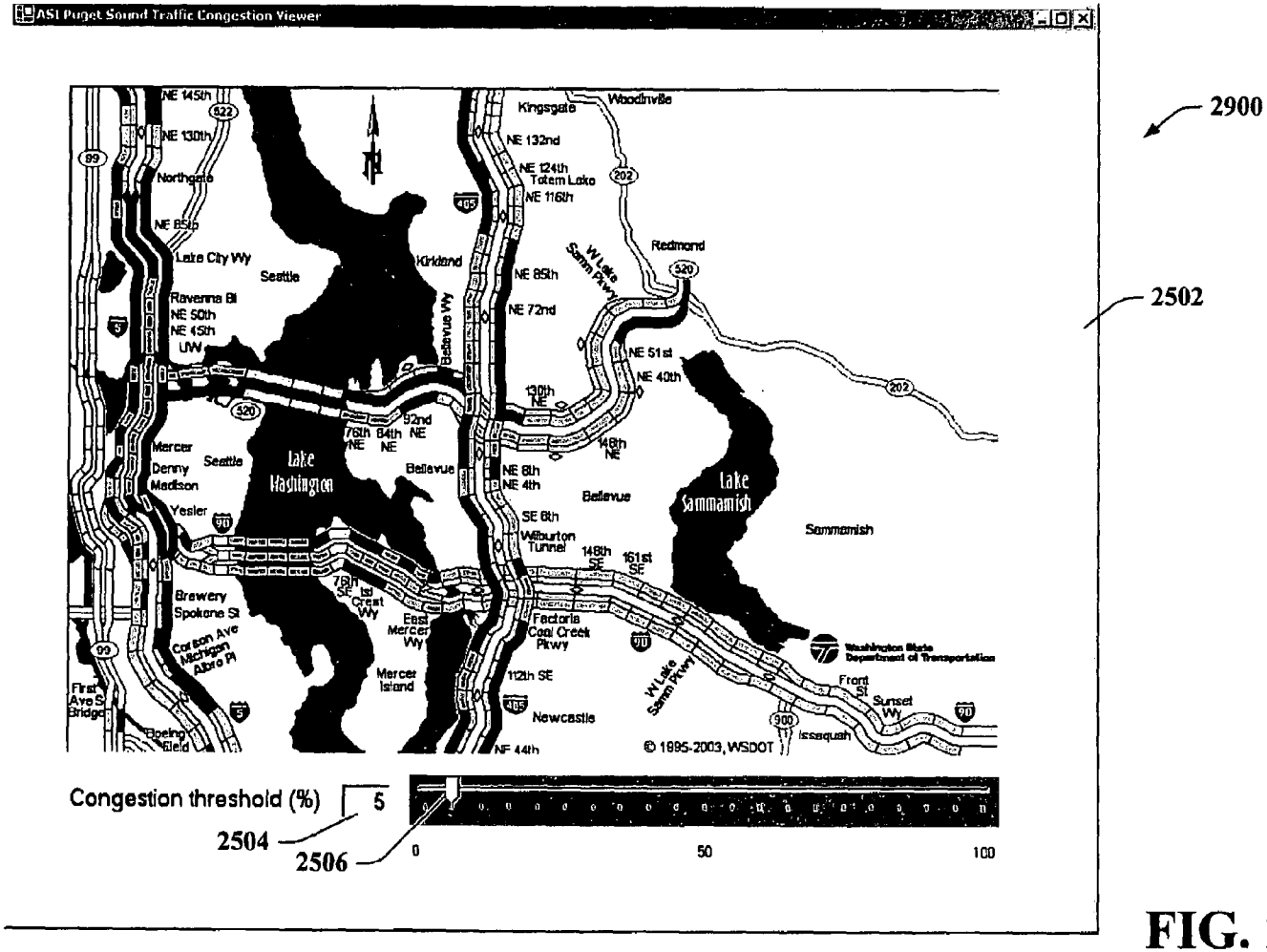
ASI Puget Sound Traffic Congestion Viewer
Woodinville
Kingsgate
Redmond
Kirkland
Bellevue
Seattle
Lake Washington
Lake Sammamish
Issaquah
Newcastle
Mercer Island
Sammamish
Bellevue
Mercer
Denny
Madison
Yesler
Brewery
Spokane St
Boeing Field
Fremont
Sunset Wy
Issaquah
Newcastle
Mercer Island
Bellevue
Redmond
Kirkland
Bellevue Wy
Lake City Wy
Ravenna Bl
NE 145th
NE 130th
NE 85th
NE 72nd
NE 132nd
NE 124th
NE 116th
NE 51st
NE 40th
148th NE
130th NE
NE 8th
NE 4th
SE 8th
148th SE
161st SE
112th SE
NE 44th
Mercer Island
East Mercer Wy
Fremont St
Sunset Wy
Issaquah
Newcastle
Mercer Island
Bellevue
Redmond
Kirkland
Bellevue Wy
Lake City Wy
Seattle
Lake Washington
Lake Sammamish
Sammamish

TRAFFIC FORECASTING EMPLOYING MODELING AND ANALYSIS OF PROBABILISTIC INTERDEPENDENCIES AND CONTEXTUAL DATA

REFERENCE TO RELATED APPLICATIONS

This application claims the benefit of U.S. Provisional Application Ser. No. 60/628,267 filed on Nov. 16, 2004, and entitled SYSTEM AND METHOD FOR PREDICTION AND PRESENTATION OF ATYPICAL EVENTS. This application is also related to U.S. application Ser. No. 11/171,063, entitled PRECOMPUTATION AND TRANSMISSION OF TIME-DEPENDENT INFORMATION FOR VARYING OR UNCERTAIN RECEIPT TIMES; U.S. application Ser. No. 11/172,581, now U.S. Pat. No. 7,519,564, entitled BUILDING AND USING PREDICTIVE MODELS OF CURRENT AND FUTURE SURPRISES; and U.S. application Ser. No. 11/171,065, now U.S. Pat. No. 7,610,560; entitled METHODS FOR AUTOMATED AND SEMIAUTOMATED COMPOSITION OF VISUAL SEQUENCES, FLOWS, AND FLYOVERS BASED ON CONTENT AND CONTEXT, each filed on Jun. 30, 2005. The entireties of these applications are incorporated herein by reference.

BACKGROUND

Electronic storage mechanisms have enabled accumulation of massive amounts of data. For instance, data that previously required volumes of books for recordation can now be stored electronically without expense of printing paper and with a fraction of space needed for storage of paper. In one particular example, deeds and mortgages that were previously recorded in paper volumes can now be stored electronically. Moreover, advances in sensors and other electronic mechanisms now allow massive amounts of data to be collected in real-time. For instance, GPS systems can determine location of an individual or entity by way of satellites and GPS receivers. Electronic storage devices connected thereto can then be employed to retain locations associated with such systems. Various other sensors and data collection devices can also be utilized for obtainment and storage of data.

Collected data relating to particular contexts and/or applications can be employed in connection with data trending and analysis, and predictions can be made as a function of received and analyzed data. Such prediction is, in fact, human nature, and individuals frequently generate such predictions. For instance, a person traveling between a place of employment and a place of residence can determine that during certain times of day within weekdays traffic conditions are subject to high levels of congestion. Thus, prior to leaving a place of work, an individual can predict when and where he will most likely to be slowed in traffic, and can further predict how long they will be subject to congestion. The individual's predictions can further be a function of other variables, such as weather, whether a day is a holiday, events that are geographically proximate, and the like. Thus, when an individual has access to contextual information and has access to (e.g., by way of memory) historical data, the individual can generate predictions.

Predictive models utilized on computer systems can often produce more accurate predictive results than a human, as computer systems may have access to a substantial amount of data. For instance, a computer application can have access to data that represents traffic patterns over twenty years, whereas an individual may have experienced traffic patterns for less than a year. These predictive models can be quite effective when generating predictions associated with common occurrences.

Predictive models, however, can fail when associated with events that are atypical or surprising. Reasons for failure can include lack of understanding of a situation, lack of contemplation of a situation, infrequency of occurrence of an event, and a variety of other factors. Alerting an individual of a surprising event, however, is more critical than alerting the individual of a typical event, because such individual may very well have predicted the typical event without aid of a predictive application. Developing a methodology for identifying events that one or more users would find surprising can be valuable as users do not need to be alerted about situations that they expect. A system could provide value to users by reasoning about when the information would surprise a user. Moreover, a system that could predict when a user would be surprised in the future would be valuable in giving forewarning to users about future states of the world, giving them time to take action such as finding a new alterative or developing a modified plan.

SUMMARY

The following presents a simplified summary in order to provide a basic understanding of some aspects described herein. This summary is not an extensive overview of the claimed subject matter, and is not intended to identify key/critical elements or to delineate the scope of the claimed subject matter. Its sole purpose is to present some concepts in a simplified form as a prelude to the more detailed description that is presented later.

The claimed subject matter provides systems and methods for utilizing a predictive model component to generate predictions relating to various applications. More specifically, a predictive model can be employed to predict occurrence of atypical or surprising events. In one particular example, the predictive model can be employed to predict traffic patterns in a particular range (e.g., a city). Data can be collected from sensors associated with roadways, including fixed magnetic, optical, acoustical, or radar-centric sensors installed on or near roadways, visual analysis of scenes captured by video cameras, information gleaned from GPS logging occurring in fleets of vehicles such as might be available from instrumented buses, taxis, delivery vehicles, and the dynamics of signal strengths, such as GSM carrier signals, sensed by cell phones, or sensed at the antennae of cell phone providers, contextual data such as day of week, time of day, and the like, whether there are events within defined range (e.g., sporting events), whether a day under consideration is a holiday, weather conditions, current traffic conditions, previous traffic conditions, incident reports that might be generated in free text with or without a formal coding, as well as other suitable data relevant to a traffic-pattern predictive application. While traffic patterns are one exemplary application, aspects of the claimed subject matter can be employed in various contexts. For instance, lines at an amusement park, stock market prediction and analysis, the availability and presence of one of more individual at different times, the time until a message such as an email message will be reviewed by a user, sales analysis of items or a plurality of items at various sales locations, and the like are exemplary contexts in which one or more aspects of the claimed subject matter can be employed.

Returning to prediction of traffic patterns, a surprising event can be defined as one that a human would not expect to occur given current contextual data. For instance, an accident can occur at one part of a city, and an individual typically will not expect such accident to affect traffic patterns at a disparate part of a city. The predictive model, however, can learn that the accident together with other data (e.g., a particular weather pattern, an occurrence of a sporting event, and so on) can cause traffic pattern alterations in a disparate portion of the city. These alterations can be an abnormal occurrence; for instance, at given times the occurrence of the predicted event can be below a pre-defined threshold. Thus, when an event that is deemed as abnormal or as one that would surprise a population of users with expectations about traffic is predicted by the predictive model, it can be displayed to a user as surprising event, or pushed to the user as an alert that they might be interested in learning about.

There are various manners in which anomalous, atypical, or surprising events can be defined. For example, a surprising event can be user-specific, where an event that is unexpected by a particular user (regardless of a probability of occurrence of an event) occurs. For instance, an atypical event can be defined as an event associated with a probability of occurring or not occurring above or below a pre-defined threshold. For example, for a particular region of a road system, and for a particular day of week and span of time of day, it may be surprising if there is a jam, or if traffic is flowing smoothly. A threshold on a small probability can be utilized, below which the event can be considered as being surprising to a population of users. Case libraries can be generated that support such definitions, and the predictive model can be built as a function of the case libraries. In another example, events can be associated with probabilities of occurring, and anomalous events can be defined as events that are associated with probabilities that are a threshold number of standard deviations away from a mean probability. It can be determined that any suitable manner for defining anomalous events is contemplated. Different models for defining surprise can also be made available for selection by one or more users. Also, richer user models can be constructed that predict situations that may surprise a user. Machine learning can be used to build such user models from data for different users.

Furthermore, a predictive model can be associated with a model analyzer that monitors the predictive model. For example, the predictive model can predict the times until traffic jams or bottlenecks will form at different locations, and the times until a jam, once formed, will melt away into a flow. The accuracy of predictions about the occurrence of surprising events can also be monitored with a specified probability. For each of these kinds of predictions, and others, the model analyzer can compare the predictions with occurrence of actual events over time, and thus monitor performance of the predictive model. The model analyzer can then automatically tune the predictive model to improve performance thereof or can simply relay to users when a prediction is likely to be accurate versus inaccurate depending on the context. In one approach to doing such automated reflection about the accuracy of predictions, a case library can be constructed of all prediction errors beyond a certain divergence from real-world outcomes, and also all observations available to a system at the time of the base prediction. Then, machine learning can be used to build predictive models about the performance of the base-level accuracies of the system, conditioned on all of the observational and contextual data available to the system. Such meta-level models that describe the accuracy of base-level predictions can be tested to confirm their accuracy. If the models are accurate, they can be executed together with the base-level predictions and can provide annotations about the likely accuracy of the base level predictions as a function of details about the observations and context. In another analysis, known as boosting, cases that are known as failures can be collected and can receive special modeling attention. For example, the failed cases can be weighted differently or handled by one or more special models in machine learning algorithms.

To the accomplishment of the foregoing and related ends, certain illustrative aspects of the claimed subject matter are described herein in connection with the following description and the annexed drawings. These aspects are indicative, however, of but a few of the various ways in which the principles of the claimed subject matter may be employed and such claimed matter is intended to include all such aspects and their equivalents. Other advantages and novel features may become apparent from the following detailed description when considered in conjunction with the drawings.

BRIEF DESCRIPTION OF THE DRAWINGS

FIGS. 25-29 are screenshots illustrating one or more practical applications of various aspects of the claimed subject matter.

DETAILED DESCRIPTION

Figure 1:
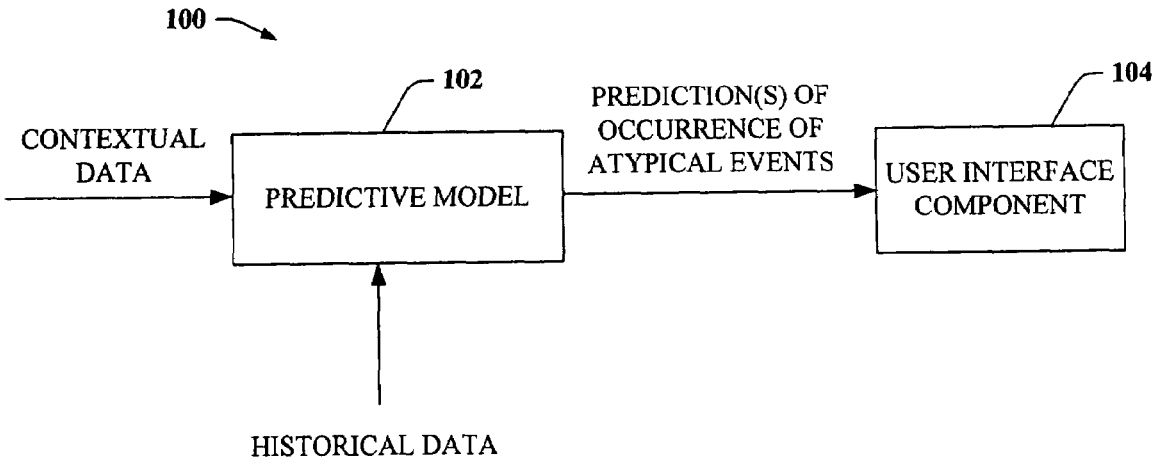
FIG. 1 is a high-level block diagram of a system that facilitates generating predictions of surprising events.

The claimed subject matter is now described with reference to the drawings, wherein like reference numerals are used to refer to like elements throughout. In the following description, for purposes of explanation, numerous specific details are set forth in order to provide a thorough understanding of the claimed subject matter. It may be evident, however, that such claimed matter may be practiced without these specific details. In other instances, well-known structures and devices are shown in block diagram form in order to facilitate describing the claimed subject matter.

As used in this application, the terms "component" and "system" are intended to refer to a computer-related entity, either hardware, a combination of hardware and software, software, or software in execution. For example, a component may be, but is not limited to being, a process running on a processor, a processor, an object, an executable, a thread of execution, a program, and a computer. By way of illustration, both an application running on a server and the server can be a component. One or more components may reside within a process and/or thread of execution and a component may be localized on one computer and/or distributed between two or more computers. The word "exemplary" is used herein to mean serving as an example, instance, or illustration. Any aspect or design described herein as "exemplary" is not necessarily to be construed as preferred or advantageous over other aspects or designs.

Automated reasoning systems (e.g., explicitly and/or implicitly trained generative and discriminatory classifiers) can be employed in connection with performing inference and/or probabilistic determinations and/or statistical-based determinations as in accordance with one or more aspects of the claimed subject matter as described hereinafter. As used herein, the term "inference" refers generally to the process of reasoning about or inferring states of the system, environment, and/or user from a set of observations as captured via events and/or data. Inference can be employed to identify a specific context or action, or can generate a probability distribution over states, for example. The inference can be probabilistic—that is, the computation of a probability distribution over states of interest based on a consideration of data and events. Inference can also refer to techniques employed for composing higher-level events from a set of events and/or data. Such inference results in the construction of new events or actions from a set of observed events and/or stored event data, whether or not the events are correlated in close temporal proximity, and whether the events and data come from one or several event and data sources. Various classification schemes and/or systems (e.g., support vector machines, HMMs, Markov processes, neural networks, graphical probabilistic models, such as Bayesian networks, dynamic Bayesian networks, and continuous time Bayesian networks, logic-based reasoning systems, and fuzzy logic) can be employed in connection with performing automatic and/or inferred action in connection with the claimed subject matter.

Furthermore, the claimed subject matter may be implemented as a method, apparatus, or article of manufacture using standard programming and/or engineering techniques to produce software, firmware, hardware, or any combination thereof to control a computer to implement the claimed subject matter. The term "article of manufacture" as used herein is intended to encompass a computer program accessible from any computer-readable device, carrier, or media. For example, computer readable media can include but are not limited to magnetic storage devices (e.g., hard disk, floppy disk, magnetic strips . . . ), optical disks (e.g., compact disk (CD), digital versatile disk (DVD) . . . ), smart cards, and flash memory devices (e.g., card, stick, key drive . . . ). Additionally it should be appreciated that a carrier wave can be employed to carry computer-readable electronic data such as those used in transmitting and receiving electronic mail or in accessing a network such as the Internet or a local area network (LAN). Of course, those skilled in the art will recognize many modifications may be made to this configuration without departing from the scope or spirit of the claimed subject matter.

One or more features described herein are applicable to the emerging class of mobile computing devices called smartphones as well as other types of portable devices including cell-phones and PDAs. By way of example, several aspects will be discussed with relation to smartphones, however it should be appreciated that the claimed subject matter can be applied to or used in conjunction with various other portable devices. Moreover, the claimed subject matter is further applicable for utilization in stationary computer devices, such as desktop PCs, as well as computing devices mounted on/in vehicles.

Smartphones combine the portability and network connectivity of cell-phones with the computing power of PDAs. The color displays of smartphones are capable of animation and usually have resolutions in the range of 200 by 200 pixels. Many of these devices do not have touch screens and even those that do are often used in one-handed situations. Most smartphones augment the numeric keypad with a four-way directional keypad (d-pad) or joystick. In addition there are several dedicated buttons (back, home, and action) and two "soft-keys" that can be arbitrarily assigned functionality by the current application.

The claimed subject model further relates to utilizing a predictive model to generate predictions relating to various patterns, such as traffic patterns, market patterns, or any other suitable context. Moreover, the claimed subject matter provides a mechanism for defining surprising situations, predicting surprising situations, and presenting such predicted surprising situations to a user (together with a calculated probability of occurrence of the predicted surprising situation).

The claimed subject matter will now be described with respect to the drawings, where like numerals represent like elements throughout. Referring now to FIG. 1, a system 100 that facilitates generating predictions relating to various patterns (e.g., traffic patterns) and delivering such predictions to a user is illustrated. The system 100 includes a predictive model component 102 (hereinafter referred to as a predictive model) that is utilized to generate predictions associated with various contexts, such as traffic patterns, sales patterns, market patterns, etc. In one particular example, the predictive model 102 can be employed to generate predictions relating to traffic patterns in a particular region (e.g., a city, a portion of a city, . . . ). More specifically, the predictive model 102 can predict/estimate an amount of time it will take for a road or entire commute path to de-congest—or to become congested. Thus, a user can review output of the predictive model 102 and make driving decisions based thereon (e.g., what time to leave a workplace, a best route to take, . . . ). Such analyses can also be used in conjunction with information drawn from a user's calendar, about when and where their next meeting is, so as to provide guidance on when to leave for a meeting. If a meeting is a first meeting of the day and a user is currently at home, the methods could extend to a smart alarm clock, waking the user up earlier if they are likely to encounter difficulties with a commute, or allowing a user to sleep in if traffic promises to be light on the way to a meeting. While the above example refers to employing the predictive model 102 in the context of predicting traffic patterns, it is to be understood that the predictive model 102 can be employed in a variety of other contexts.

The predictive model 102 can be based upon any known data modeling technique. In one example, the predictive model 102 can be based upon a Bayesian network and employ various machine learning techniques to optimize predictions output from such predictive model 102. Bayesian networks are directed acyclic graphs of nodes that represent random variables and arcs that represent dependence relations between nodes (variables). Thus, for example, if an arc exists from a first node to a second node, then the first node is said to be a parent of the second node. If the node is associated with a known value, it is referred to as an evidence node. Nodes can represent any suitable type of variable—for instance, nodes can represent observed measurements, parameters, latent variables, or hypothesis. Thus, in drawings described herein, nodes can represent contextual data such as day of week or time of day, as well as status of traffic at a particular location, and various other variables. Machine learning refers to an area of artificial intelligence concerned with development of techniques that allow computers to "learn" predictive or explanatory models from sets of observations. More particularly, machine learning can relate to methods for creating and/or modifying computer programs based at least in part upon an analysis of data set(s). Thus, if collected data shows that a certain portion of a road is blocked at a particular amount of time at a certain time on specific days, the predictive model 102 can watch such blockage and refine and optimized predictions based upon this pattern.

Enabling optimal/desirable operation of the predictive model 102 necessitates receipt of a substantial amount of data. Referring specifically to prediction of traffic patterns, data can be collected from various sensors on roadways, traffic reports translated to machine-readable language, an aggregation of GPS data, monitoring hand-shaking between cell phones and towers as users traverse through a region—as either observed at the cell phones or at the cell towers, and various other manners of collecting data from users. Moreover, data such as weather conditions, such as visibility, precipitation, and temperature (e.g., freezing) (collected from web sites, a radio station, or other suitable source), calendar information (such as time of day, day of week, month, and the like), whether a major event, such as a sporting event, parade, movie opening, political events, and the like, is occurring in the contemplated geographic region or associated regions, holiday status (major holiday, banking holiday, school holiday, etc.), and any other data that may be related to traffic can be collected. For instance, ongoing free text or coded reports from government or private traffic monitoring departments can be collected. The collection can occur through websites, through translation of natural spoken language, through sensors, user input, or any other suitable manner. Again, it is to be understood that predicting traffic patterns is merely one exemplary application in which one or more aspects described herein can be employed—various aspects, including market analysis, are contemplated by the inventor and are intended to fall under the scope of the hereto-appended claims.

Upon building the predictive model 102, contextual data as well as historical data can be received by the predictive model 102. As described above, such data can be collected through various sensors as well as websites and calendars. For instance, the data can include time of a sporting event, time of a concert, current time of day, amount of current traffic, and any other suitable data. This data can be delivered to the predictive model 102, which can thereafter generate predictions relating to the application for which the predictive model 102 is designed. Returning again to the traffic pattern prediction application, the predictive model 102 can output predicted congestions, predicted time until a current congestion is cleared and a standard deviation associated with such prediction, and any other suitable predictions relating to traffic patterns. For instance, information output to a user can be color-coded to relay rate of travel and density of vehicles to a user. In a specific example, when there is an uninhibited and rapid flow of traffic, portions of a graphical depiction of a highway system can be associated with the color green. As roadways become more congested, the color can alter from green to yellow, from yellow to red, and from red to black, wherein each alteration indicates a disparate rate of travel. The information output to the user can relate to current conditions (e.g., traffic conditions) and/or relate to predicted future conditions.

With still more detail with regards to traffic, particular portions of roadways can be selected with respect to which data is provided to a user. For instance, cities can be associated with a set of well-known "hotspots" that lay at the focus of attention of commuters and traffic reporters during commuting. Identification of such locations (e.g., bottlenecks) enables a more focused modeling and alerting, wherein alerts can relate to a set of events and states highly relevant to a user. Such a framing aids in reduction of parameter space of learning and inference effort utilized in designing the predictive model 102 as well as providing a representation of traffic issues that is easily communicated to users. To determine whereabouts of such locations, system-wide traffic flow data can be analyzed to obtain information relating to percent of congestion and time of congestion, wherein the percent of congestion can be altered. Utilizing such an analysis can enable determination of a location of bottlenecks in a system, and the predictive model 102 can be built accordingly, where the predictive model 102 can generate inferences relating to expected time until occurrence of a level of traffic congestion, a predicted time that such level of congestion will remain, and the like. Additional data relating to traffic flow can also be collected and utilized by a predictive model. For instance, data relating to traffic patterns, which can be static and/or dynamical data relating to flows and jams (congestions) in different parts of a traffic system, including time since jams have occurred, extent (how long of a segment) and texture of a jam (e.g., solid jam, mixture of flows, etc.) time since a jam has melted, changes of flows within a region that had been jammed solidly, etc. Thus any suitable data relating to context, dynamics, and/or current/previous traffic data can be utilized.

In more detail, given sufficient data collected by way of the mechanisms/methods described above, machine learning can be employed to learn about the probability distributions over future trends as a function of time and other contextual information. For example, in a traffic application, flow of traffic in particular portions can be monitored over time, and machine learning techniques can be employed to predict such flows given current observations. For instance, a user can travel over a particular route from an office to a place of residence, and such route can be learned over time. Furthermore, contextual data associated with the route can be collected, and machine learning methods/mechanisms can be utilized on the collected data. Thereafter, given current observations associated with the route, inferences can be generated with respect to the route and the user can be provided with alerts and/or data associated with the route.

For instance, the predictive model 102 can guide in creation of a proposed traffic route given particular data relating to traffic. For instance, the predictive model 102 can propose a route to a user given current status of traffic. In another example, the predictive model 102 can utilize marginal or mean traffic flow expectations based on the consideration of such evidence as time of day and day of week and key current jam problems to guide in creation of a proposed route from a point of beginning to an endpoint (e.g., from a place of business to a residence, from a current traffic position to a residence, . . . ). In still another example, the predictive model 102 can generate probabilistic forecasts about future traffic flows in different regions to guide the creation of traffic route planning. Furthermore, given current locating information (and direction of travel), the predictive model 102 can guide in re-planning a proposed traffic route during a drive based on an attempt to minimize total driving time. For instance, GPS can be employed to locate a user currently and utilized in connection with providing information on traffic now and predicted traffic events in the direction of travel.

Furthermore, the predictive model 102 can predict occurrence of surprising events given the contextual data and/or historical data (e.g., both contextual data and historical data may not be required to generate a prediction of an anomalous occurrence/event), where a surprising event is one that would surprise a particular user or set of users. To enable prediction of surprising events, definitions relating to the surprising events can be generated. For one example, a probability of occurrence of an event can be analyzed to determine whether an event is surprising. More specifically, a high and low probability threshold can be defined, wherein a user of the system 100 would either expect an event to occur or not expect an event to occur with a particular probability. If the probabilities of such occurrences lie outside the threshold, a user can be notified of a predicted surprising event. For a specific example, a user can expect to travel a particular portion of highway without congestion given past experience and current context. Due to other events not thought relevant to the user or not contemplated by the user (but known to be relevant to the predictive model 102), the portion of highway can be predicted as congested at a probability above the defined threshold. The predictive model 102 can thereafter provide the user with this predicted surprising event/occurrence together with a probability of such occurrence, thereby enabling the user to travel a disparate route and/or leave at a different time if the user so chooses. Moreover, disparate models can be associated with the predictive model 102 to ascertain accuracy of the predictive model 102. The predictive model 102 can then be tuned as a function of the ascertained accuracy.

Discussing with more specificity surprising events, such events/occurrences can be defined as unexpected events to a user. The system 100 can utilize representational, inferential, and decision making methods that can be employed to forecast surprising events/occurrences that arise at future times. The system 100 can apply to prediction of surprising outcomes in a context, surprising failures of a system's or person's ability to understand, solve, or predict future problems as a function of encountering unexpected situations or incompetencies in one's own abilities to face the future based on sensed or observed situations, etc. Learning and reasoning about future surprising events extends to learning and reasoning about future unmodeled situations. Surprising events for individuals and/or automated reasoning systems can be categorized as either (1) an event that is not explicitly considered by an observer (e.g., events that are not modeled); and (2) an event that is assigned a low or high probability, lower and/or higher than a threshold probability of occurring. In addition, outcomes or situations that are considered to be significantly surprising often have a significant influence (positive or negative) on utility of an observer who is surprised by the unexpected or unmodeled event. To briefly summarize, surprising events/occurrences can be identified explicitly but are not expected to occur, or are not expected to occur within a threshold probability, or are events/occurrences not modeled or reasoned about (e.g., they lie outside a scope of what is being modeled). In practice, many events can occur that are not considered explicitly; however, when such events occur they can influence utility of one or more agents, and are therefore considered surprising.

Conventional systems and methodologies for detecting surprising events from data center upon identification of surprises in present or past. These conventional systems/methodologies, however, do not forecast or predict future surprising events, situations, or occurrences. Predicting future surprising events/situations/occurrences can prove valuable for preparing individuals, organizations, and systems for events that they do not expect to occur or are not considering at all. To generate this model within the system 100, the predictive model 102 can include a "world" model that predicts events in the future as a function of present and past observations. The predictive model 102 can also compare a likelihood of future outcomes to a model of what an observer expects based on past and present observations. Future surprising instances can be defined in terms of future expectations or "models of typicality." Thus, in order to generate a model for forecasting surprising instances, a definition of expected outcomes and surprising outcomes can be generated.

Such a definition can be simple, such as "a future surprising instance occurs when something occurs in the future of some consequence positive or negative to the observer that the observer did not expect to happen" or did not ever represent nor think about as feasible because of biases in reasoning about typicality coupled with representational and computational limitations. Other possible definitions of future surprising instances include an occurrence of a situation that an observer or automated reasoning system had represented implicitly or explicitly but had assigned a likelihood smaller than a probability threshold x of occurring. Such probability thresholds can be created as functions of an event type or implications of an event. Observers or computing systems can assess, represent, or implicitly leverage a probability distribution over disparate probabilities of an event. One rationale that may be considered in connection with designing the predictive model 102 to generate predictions surprising events with respect to an observer is that the observations and outcomes that are considered explicitly in forecasting situations may be different for a model representing an observer's outlook on events (e.g., using background statistics based on a subset of variables) than for the richer probabilistic model (e.g., considering higher-order interactions among the same variables, or among larger sets of observational variables and outcomes of interest), and the predicted future outcomes predicted by richer models can diverge significantly from a more simple observer model. Specifically, observers often do not contemplate or comprehend interaction of variables that can cause occurrence of an unexpected even. A richer, probabilistic model takes into account this interaction of variables, as well as other variables not contemplated by the observer. Thus, predicted future outcomes generated by rich, probabilistic models can differ drastically from predicted outputs of an observer-based model.

In one exemplary approach, the predictive model 102 (which can include a plurality of models) can include statistical machine learning methods such as learning procedures for building Bayesian network models, and temporal variants, including dynamic Bayesian networks, and continuous time Bayesian networks, as well as other statistical classifiers, such as supportive vector machines and neural net methods. Predictive models can be constructed by way of structure search and parameter optimization to design models that can best explain data about base level inferences and about surprising instances. In one exemplary creation of the predictive model 102, a case library capturing cases or situations where world outcomes are defined as surprising in the context of an observer model can be built and analyzed. Such training sets (the case library) will differ depending on the world events and the definition of a surprising event.

Given a case library (not shown) of sets of observations at some time t0 about a situation, whether or not events at some future time t>t0, or, for instance, within segments of time t3-t5, in the future are defined as surprising can be considered. The predictive model 102 can thus be built to forecast surprises, at different future times, as a function of data within the case library. Such model 102 can be focused only on events that have some positive or negative influence on utility greater than some thresholds or different thresholds depending on the type of event. Models of future surprising events can be defined and focused based on a nature of mean costs associated with the surprising instance and/or of atypically costly outcomes that can be avoided if action is taken in advance. Analogously, the predictive model 102, designed as a surprising instance forecasting system, can include models that forecast potentially beneficial surprises, for which actions could garner or further enhance a positive nature associated with a benefit or unexpected benefits coming from outcomes. In a competitive situation, decision models coupled with the expectations of an adversary could be used to generate surprises or negative surprises for an adversary, or surprising situations that tend to have benefits for allies and costs for adversaries.

In building the predictive model 102 by way of accumulated case libraries, such libraries can be focused on only surprising future events that are considered to likely influence the utility of an observer in a negative way, or can be focused only on future events that will likely influence users in a positive way. The events can focus on surprises of either likely negative or positive kind. The events can also be of poorly characterized utility—as a number of events can be simply surprising to a set of observers, such as the discovery of intelligent life from another solar system in a time in the future. Surprising events also include those not linked to the observers' utility, but can be linked by way of the utility of others, where a surprise is partly defined by empathetic reflection. For example, an observer may find it surprising to learn that at a future time a pandemic has killed several million people in Southeast Asia.

As an example of a model of surprising events, second-order probability distributions on beliefs about a long-term probability can be considered by the system 100 and/or the predictive model 102 in reasoning about surprising events/conditions. For example, a Beta distribution can be used to model the probability distribution over different long-run probabilities of a series of flips of a coin of unknown properties. An surprising instance about the long-term probability can be defined in terms of a current mean and sample size, which yields a probability distribution over the mean that may be tight, or have increasingly large variances, capturing a lessening of confidence in the long-term probability given prior observations. A surprising future outcome can also be defined in terms of a current probability distribution over long-term probabilities, where a system is more surprised in situations where one or more outcomes (e.g., a series of outcomes of a coin flip) has a mean probability that is represented as having a probability of lower than some threshold probability, in the context of a current probability distribution over the long-term probabilities.

In a general machine learning approach to building and using the predictive model 102 to predict surprising events and/or occurrences, the system 100 can model future surprising events or anomalies by considering cases of unexpected outcomes in a future time, defined as some number of minutes in the future, coupled with the observations in the present time. To build the predictive model 102, a case library can be constructed and models can be built and tested with holdout data to probe the predictive accuracy of the surprising instance forecasting.

As an example for defining expectation and surprise in one approach, probability distributions over scalar-valued variables defining events of importance can be employed by the predictive model 102 to define surprising outcomes. For example, traffic volumes that influence flows at different potential bottleneck regions of a city's highway system can be considered. If the probability distribution of volumes at each potential bottleneck at a time 30 minutes from observation time is represented and conditioned on a set of influencing variables, such as one or more statistics on recent history of traffic flows for that bottleneck and other bottlenecks as well as the time of day and day of week, holiday status, and other potentially important influencing variables such as the status of accidents and their time and degree throughout the highway system, construction status, weather and visibility, and start and end of major events like sporting games, ballet, and theater, a probability distribution over the flows of bottlenecks for different contextual situations, captured by the settings of the variables, can be recorded and encoded.

In one exemplary creation of the predictive model 102, a central tendency as a model of expectation of an observer, given the probability concentrated in this region, can be utilized. Thereafter a case library of cases where the outcome was a much lower or higher volumes can be built. More specifically, cases can be identified where there are unexpected or surprising volumes of traffic, where volume is some number of standard deviations higher and lower than the mean—and such identified cases can be considered surprising. The predictive model 102 can therefore include a predictive model of cases where there is likely to be such a situation, as a probabilistic model of surprise.

Thus, an assumption can be made that commuters traveling through regions of potential bottlenecks may have an expectation based on a mean or central mass of the probability distribution at some target number of minutes in the future based on current observations. Thus, an "observer's" model of expectations, which can be included within the predictive model 102, might be encoded as a mean+/−a standard deviation. In a more sophisticated model that can be employed within the predictive model 102, the differences in inferential abilities or evidence considered in the aforementioned observers model can solely be considered explicitly. For example, for the observer's model, the means and variances associated with a few basic contextual pieces of evidence can be considered, such as time of day and day of week, and the consideration of subtle sets of findings that may interact to produce surprising flows can be removed. To pick surprising cases for training, cases associated with very high and very low flows at different points in the future can be selected, and all observational variables at a current time in a training set for machine learning of models that can predict surprising instances can be noted.

Focusing on the example, an observer's model, for example, can consider the volume of traffic at a potential bottleneck region in 30 minutes to be a function of a set of observations now and the last 30 minutes based on the following function:

Volume in 30 minutes=$f$(volume Bottleneck 1 now (bn1), time of day, day of week).

This information is encoded as a mean and standard deviation. The predictive model 102, however, can employ a more sophisticated world model that can consider additional variables and their dependencies, and can encode the volume as a Bayesian network, as in the following:

Volume in 30 minutes at Bottleneck 1 now (bn1)=$f$ (volume bn1-bn30 now, volume trend bn1-bn30 last 30 min, time of day, day of week, volume in 30 minutes to include, Sonics game start time status, holiday status, precipitation status)

If both models are executed on received observations, predictions generated relating to the bottleneck in 30 minutes can be very different, and such differences can be employed to determine instances where the predictions in 30 minutes will likely surprise an observer. In a second approach, a set of cases where a user would have been surprised can be encoded, and the predictive model 102 can directly encode surprising situations for an observer based at least in part upon a set of findings. Thus, the predictive model 102 can discover that certain settings of interdependent variables lead to "surprising" (e.g., atypical or anomalous) high or low volumes from the point of view of simpler model of mean and standard deviation. Surprising real-world events predicted by the predictive model 102 can be constructed, and compared to expected the outcomes predicted by an observer at a future time of interest (e.g., 15 minutes from now, 30 minutes from now, 1 hour from now, or within time t from now), and models of surprise via machine learning to build predictive models of surprise can be constructed.

In yet another approach, models that do not reason about specific types of events directly but about higher-level properties of surprises, atypicalities, and/or anomalies conditioned on occurrence thereof can be employed in connection with the predictive model 102. For example, whether a surprising instance within some time frame, should it come, will be of a particular class can be predicted. As an example, data associated with properties of surprising events of the highest degree that had occurred with a past year with respect to an observer can be collected, and statistics relating thereto can be employed as a model for reasoning about potential surprising instances in the future. For example, a set of properties associated with events that were the top n most surprising events of each of the past 10 years, in private or public realms, can be assessed. These marginal statistics can be utilized to order properties of future surprising instances should they occur. For example, "involves a group of coordinated activities that had been cloaked from view," "involves financial instruments that had not been modeled explicitly," etc.

Machine learning can be utilized also to reason about future situations that are associated with outcomes that will be especially challenging or difficult, as possible outcomes may have not yet been modeled or situations can exist where the predictive model 102 can determine that it is incompetent in certain circumstances. By way of an aforementioned approach, situations can be captured where an outcome was discovered to not be explicitly modeled within the predictive model 102 or other models or that a system failed in a surprising manner. A case library of cases about a forthcoming likely failure like this can be analyzed in connection with such utilization of machine learning. For building a predictive model of forthcoming unmodeled situations or incompetencies based in the poor handling of unmodeled situations, or simply identifying unmodeled situations, a case library of situations of forthcoming unmodeled situations or poor responses can be built, and such situations can be predicted by way of the predictive model 102. Predictive power of the constructed predictive model 102 can be tested by way of constructing the predictive model 102 from a training set of cases, and testing predictive power of such the model 102 against set test data retained for such purpose.

Another approach to building the predictive model 102 while contemplating unmodeled situations is to construct the predictive model 102 with an ability to predict that there will be a failure to predict the future, so as to inform a user or system when a prediction output by the predictive model 102 is not likely to be correct. Machine learning can be employed to identify such a situation by noting sets of observations or states associated with an inability to predict the future. Such models of future surprise, atypicality, anomalies, unmodeled events, or, more generally, situations that will not likely be handled well by a system or person can be utilized to warn people or automated systems that there is likely to be an unexpected, confusing, or unmodeled situation coming up based on current observations. Having knowledge about the likelihood of such situations approaching in the future, even when uncertain, can warn an individual or system when they may wish to ready for the surprising or substantially challenging situation, so as to enable choice of an alternate context or situation.

The predictive model 102 can be further used to guide or promote situations where a person or system may be placed in unexpectedly valuable situations under uncertainty. Displays can be driven to alert of information based on differences between the inferences of a model of an observer's expectations about the future and a richer, more accurate model of world outcomes for that same future time period, wherein both of such models are resident within the predictive model 102. These displays can assume that people or systems have default expectations and there's no reason to alert them unless it is likely that something is or will be surprising to the user in the future. On alerting systems, as an example, moving back to the traffic prediction application, individuals can be alerted as to when they can expect traffic volumes to be surprisingly lighter or heavier along routes of interest for times of interest in the future. These individuals may not wish to be alerted with respect to traffic conditions the individuals come to expect (as determined by a observer-based model of expectancy). As another application, based on inferences about a future forecast that is surprising users can be alerted to begin a trip earlier or later within the constraints of arriving at a distant location by some time. In another example, the predictive model 102 can be employed within an alarm system and can awake a user from sleep later or earlier in the morning given prediction of surprising event that affects the user.

The predictive model 102 can include models (not shown) that provide predictions about an ability of the predictive model 102 to accurately predict surprising events/occurrences in the future. Thus, the predictive model 102 can automatically highlight the accuracy of a prediction, or can determine instances in which to distrust a prediction, thereby enabling a user to rely less on the prediction in preparing for the future. A robotic system may wish to use a model for forecasting unmodeled or surprising events coming up on the current path or trajectory, or extra challenging situations where it will likely be incompetent, per the inferences of a predictive model of unmodeled events, or of inability to predict, or of surprising failure, so as to select an alternate approach or path, where it is less likely going to face a surprise or challenge.

Upon generating a prediction or occurrence of surprising events, the predictive model 102 relays such prediction to a user interface component 104, which can present generated predictions to a user. For instance, the user interface component 104 can be associated with a graphical user interface (GUI) that visually displays generated predictions to a user, speakers that audibly provide predictions to a user, or any other suitable interface. Moreover, the user interface component 104 can be resident upon a portable device, such as a laptop, PDA, cellular phone, smart phone, and the like, or be resident upon an affixed device, such as a desktop personal computer. In a traffic application, the user interface component 104 can dynamically display a route to a user by traversing such route, wherein an amount of a zoom while traversing is a function of distance between data points on a map, distance in the route from one or more data points, number of data points in a route, etc. For example, a user may desire to travel a certain route, where there are several portions of highway along such route that are of interest to a user (such as a plurality of portions of highway that are congested or are predicted to be congested). At the beginning of the route, the display can be associated with a particular zoom as the display begins traversal of the route, the display "zooms out", the rate of the zoom a function of distance between data points, distance between one data point, and/or number of data points on the route. The zooming is utilized to provide the user with a greater amount of context with respect to a route, and has empirically been shown to be more pleasing to users than conventional systems. As the user interface component 104 (e.g., a display) shows the user nearing a data point, the display will "zoom in", the rate of the zoom again a function of distance between data points, distance between one data point, and/or number of data points on the route.

The system 100 can be implemented on a combination of a server and a client or on a client alone. For example, a computing device that includes the user interface component 104 can subscribe to a service that hosts the predictive model 102. The predictive model 102 can be associated with a processor and memory upon the server, and calculations can take place thereon. Generated predictions can then be delivered to the user interface over a wireless and/or wireline network. Furthermore, for a map or portions thereof can be delivered to a client and cached in memory thereon. Display relating to predictions can thereafter be delivered from the server and positioned over the graph cached upon the client. As processing and memory capabilities increase, however, the system 100 can reside entirely within a client.

Figure 2:
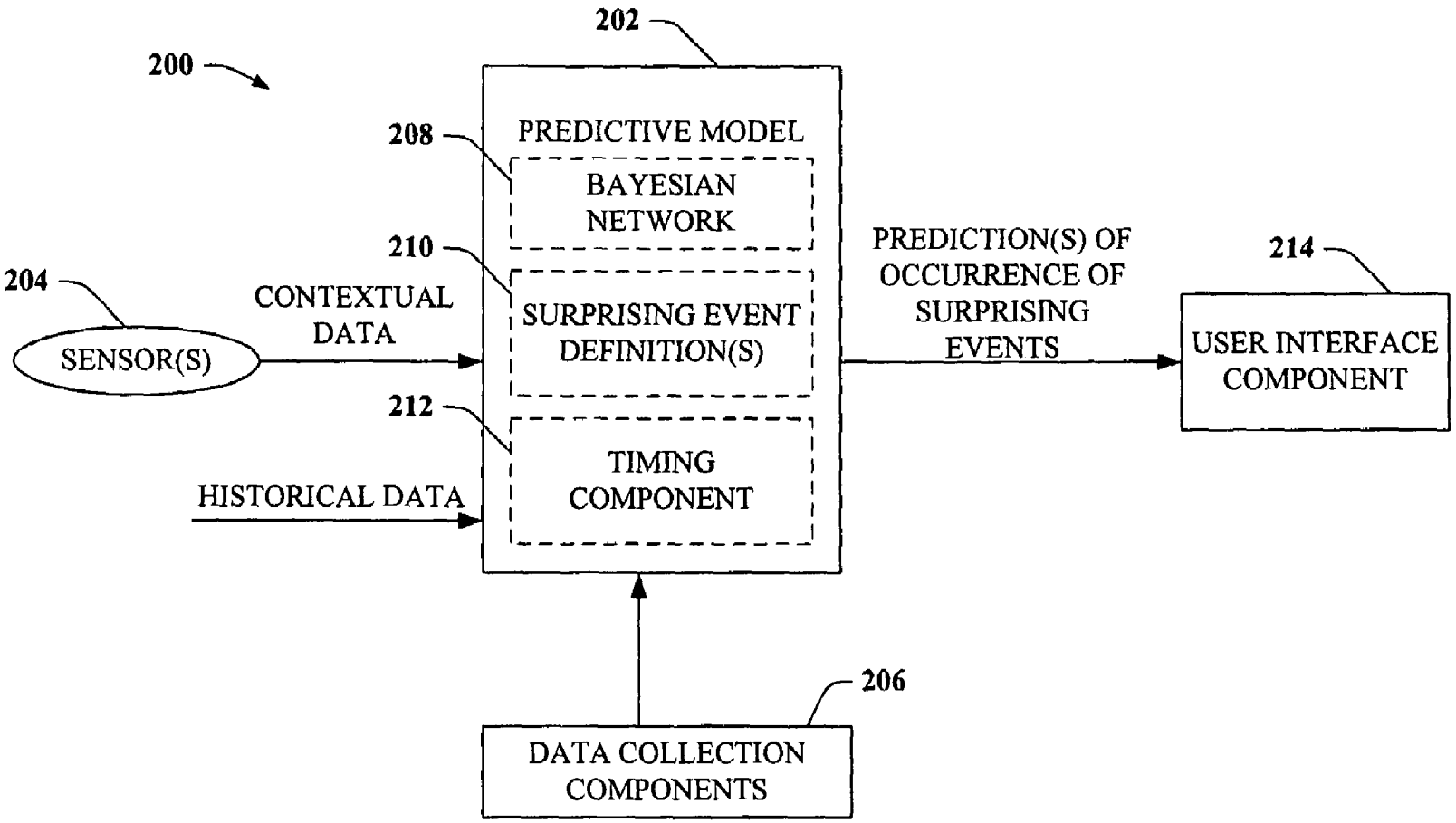
FIG. 2 is a block diagram of a system that facilitates retrieving contextual data and utilizing the received contextual data in connection with generating predictions of surprising events.

Now turning to FIG. 2, a system 200 that facilitates generation of predictions of surprising events/conditions is illustrated. The system 200 includes a predictive model 202 that generates predictions relating to surprising events as a function of received contextual data and historical data. Contextual data can be delivered to the predictive model 202, for example, by way of one or more sensor(s) 204 and/or by way of one or more data collection components 206. For instance, in an application where the predictive model 202 predicts traffic patterns, the sensor(s) 204 can be weight sensors on a roadway that detects existence of automobiles, approximates speed of automobiles, and the like. In another example with respect to the traffic, GPS sensors associated with automobiles can be utilized in connection with receiving contextual data relating to automobiles on a roadway. These sensors can be integrated within an automobile, within a cellular phone, a PDA, and the like. In yet another example, the sensor(s) 204 can be related to monitoring hand-shaking between cellular phones and cellular towers, thus providing yet another indication of location of individuals upon a roadway. Furthermore, sensor(s) relating to temperature, time, etc. can be utilized to obtain contextual data. Accordingly, any suitable sensor can be employed in connection with obtaining contextual data for utilization by the predictive model 202. The data collection components 206 can be utilized for monitoring television, radio, and the Internet for variables relating to an application for which the predictive model 202 is designed. For example, if the predictive model 202 is utilized in connection with traffic prediction, it is well known that day of week, occurrence of sporting events, and weather can affect traffic. Thus, the data collection components 206 can obtain data through utilization of voice recognition mechanisms to determine weather described in radio news broadcasts, text-recognition mechanisms for monitoring sporting events or other suitable events, and the like. Thus, any suitable device/mechanism for obtaining contextual data that can be employed by the predictive model 202 is contemplated.

The predictive model 202 can, for example, be built by way of statistical methods, such as through utilization of one or more of graphical probabilistic models, such as Bayesian networks, dynamic Bayesian networks, and continuous time Bayesian networks, Hidden Markov Models (HMMs), Markov processes, particle filtering, Gibbs-sampling based approaches, neural networks, support vector machines, differential equations, logic-based reasoning systems, and fuzzy logic-centric methods. In one particular example, the predictive model 202 can utilize one or more Bayesian networks 208 in connection with generating predictions of future surprising events. The Bayesian network 208 can include variables that influence abstracted events, and these variables and influences can be modeled therein. For instance, the Bayesian network 208 can include random variables that represent the time until congestion and time until clear for sets of troublesome traffic hotspots or bottleneck regions in a traffic system, and predicting traffic flow can relate to reasoning about such random variables. Furthermore, a tool (not shown) for analyzing and identifying bottleneck regions can be utilized in connection with the predictive model 202. Depictions of an exemplary tool that can be utilized in connection with the predictive model 202 can be found at FIGS. 25-29.

Continuing with examples relating to prediction of traffic conditions, an accident at a particular region of a first roadway can affect traffic conditions at a specific region of a second roadway. In another example, weather conditions can have a greater affect on particular portions of specific roadways than portions of other roadways. Thus, the variables within the Bayesian network 208 can include abstractions of portions of roadways, accidents affecting traffic thereon, weather relating to traffic thereon, and any other suitable number of variables. The Bayesian network 208 can be a substantially complete representation of roadways and variables affecting traffic thereon. In another example, the Bayesian network 208 can be employed to model user expectancies, wherein such expectancies can be drastically different from predictions output by a robust model.

The predictive model 202 can include surprising event definition(s) 210, which are utilized to alert an individual of possible occurrences a surprising event. The surprising event definition(s) 210 can be created and/or defined in various manners, at least some of which were described with respect to FIG. 1. For instance, the surprising event definition(s) can relate to events that occur above and/or below a threshold probability. Thus, a user can be alerted if a predicted probability of occurrence lies outside the threshold. In another example, the surprising event definition(s) 210 can relate to events that are not modeled by an observer-related model, and thus such events defined by the surprising event definition(s) 210 are generally not expected by a user. Accordingly, disparate models, an observer-related model and a more thorough, substantial model can be utilized in connection with the surprising event definition(s) 210 to determine existence of a surprising event and alert an individual of impending occurrence of such event and/or a probability thereof. It is understood, however, that any suitable manner for defining surprising event(s) is contemplated and intended to fall under the scope of the hereto-appended claims.

The predictive model 202 further includes a timing component 212 that assists the predictive model 202 in outputting time data together with predictions relating to future surprising events. For instance, informing an individual that traffic will be congested at a particular area sometime in the future is not helpful to the individual, as such individual will have no way of knowing at what time the congestion is expected, length of expected congestion, and the like. The timing component 212 can thus be utilized to associate time values with predictions output by the predictive model 202, thereby providing a user with requisite information that can be employed for making decisions as a function of a predicted future surprising event. The system 200 further includes a user interface component 214 that provides predictive information to a user. In accordance with one example, the user interface component 214 can exist within an automobile, thereby allowing dynamic predictions to occur as a user is traveling.

To assist in determine regions that a user cares about, a tool/interface (not shown) can enable a user to select sets of hotspots or bottlenecks and label them as regions that they care about, including selection of sets of bottleneck regions that comprise routes (e.g., commute routes) by selecting sets of bottleneck regions and linking them to times of day, when the regions or whole routes are monitored, actively and when desktop or mobile alerting (e.g., via an alert on a Smartphone or via an SMS message on a normal cell phone) will occur if mobile alerting conditions are met (e.g., right time of day, alerting conditions are met, and user sensed to not be present at a desktop). Smartphones can be set up to show the appropriate bottlenecks per time of day, via flyovers, automated scrolling etc.

Figure 3:
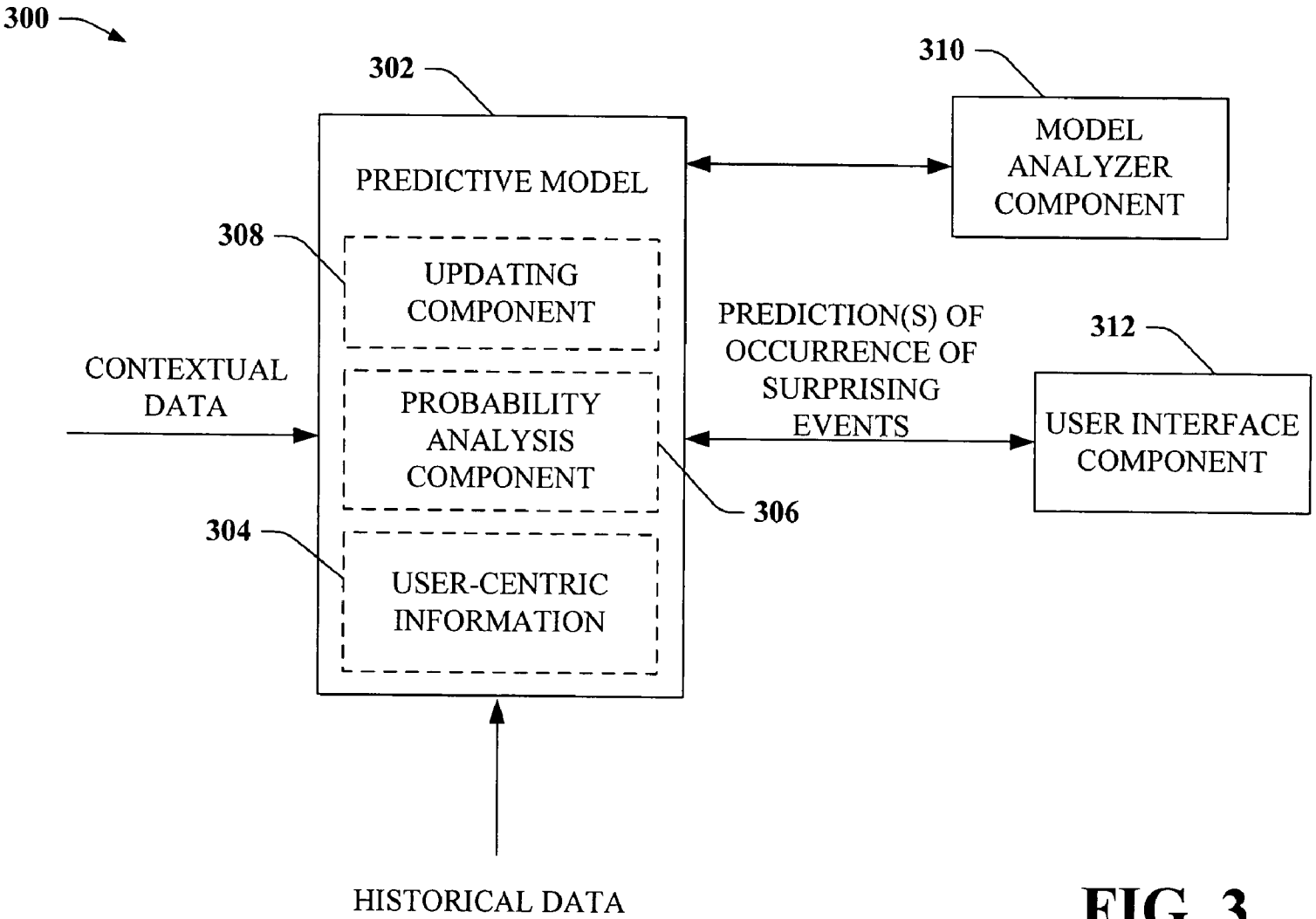
FIG. 3 is a block diagram of a system that facilitates analyzing and automatically updating a predictive model that predicts occurrence of surprising events in the future.

Now referring to FIG. 3, a system 300 that facilitates generation of predictions of surprising situations that may occur in the future is illustrated. The system 300 includes a predictive model 302 that generates predictions of future surprising events, and can further generate probabilities associated with the predictions. The predictive model 302 generates predictions of surprising events (or atypical/anomalous events) as a function of received contextual data and received historical data. The predictive model 302 includes user-centric information 304, thereby enabling the predictive model 302 to determine events that will surprise a user. More specifically, the user-centric information 304 can be employed by the predictive model 302 to determine which predicted surprising events are important to the user. As an example, the user can leave a place of work every day at 3:00 and travel a certain route to return to a place of residence, wherein the route is typically not be subject to traffic congestion. Thus, if the predictive model 302 predicts that congestion will occur on the route the user typically takes, the predictive model 302 can inform the user of this predicted congestion. If, however, the predictive model 302 predicts congestion on a route not traveled by the user, it may not be desirable to provide the user with such prediction (as it does not relate to the user).

The predictive model 302 can further include a probability analysis component 306 that determines probabilities associated with surprising events. For example, a user may not wish to be provided with a prediction of a surprising event associated with a very small probability of occurring. Accordingly, the probability analysis component 306 can compute probabilities associated with predicted surprising events, and the user can be provided with the prediction if the calculated probability is above or below a defined threshold.

The predictive model 302 can also include an updating component 308, which enables a user to inform the predictive model 302 of events that the user considers surprising. The updating component 308 can be of importance when particular events are not modeled and/or are not considered surprising by the predictive model 302. In an instance that the surprising event was not modeled, the updating component 308 can receive information from a user regarding an event that the user considers to be surprising and can obtain contextual data associated with the event (from sensors, radio, user input, and the like). The predictive model 302 can therefore be expanded to include the event specified by the user. In an instance that the event has been modeled but the predictive model 302 did not consider occurrence of the event to be surprising, the updating component 308 can receive user input and cause the predictive model 302 to output the event as a surprising event if prediction of such event should occur in the future.

The system 300 can further include a model analyzer component 310, which analyzes accuracy of the predictive model 302 and automatically tunes the model 302 to improve performance thereof. For example, the model analyzer component 310 can track predictions output by the predictive model 302 and compare such predictions to occurrences of events. The model analyzer component 310 can utilize various machine-learning algorithms and/or techniques to automatically tune the predictive model 302 to improve performance of such model 302. In particular, the model analyzer component 310 can include a Bayesian network, fuzzy logic systems, neural networks, or any other suitable machine-learning mechanisms.

The system 300 further includes a user interface component 312 by way of which a user can communicate with the predictive model 302 to provide information to such model 302. For instance, a user can inform the predictive model 302 of what he believes to be a surprising event by way of the user interface component 312. To facilitate such communication, the user interface 312 can employ voice recognition systems, pressure-sensitive screens, pointing and clicking mechanisms, magnetic pointing mechanisms, and/or any suitable combination thereof. The user interface component 312 can further be utilized to communicate predictions output by the predictive model to a user.

Figure 4:
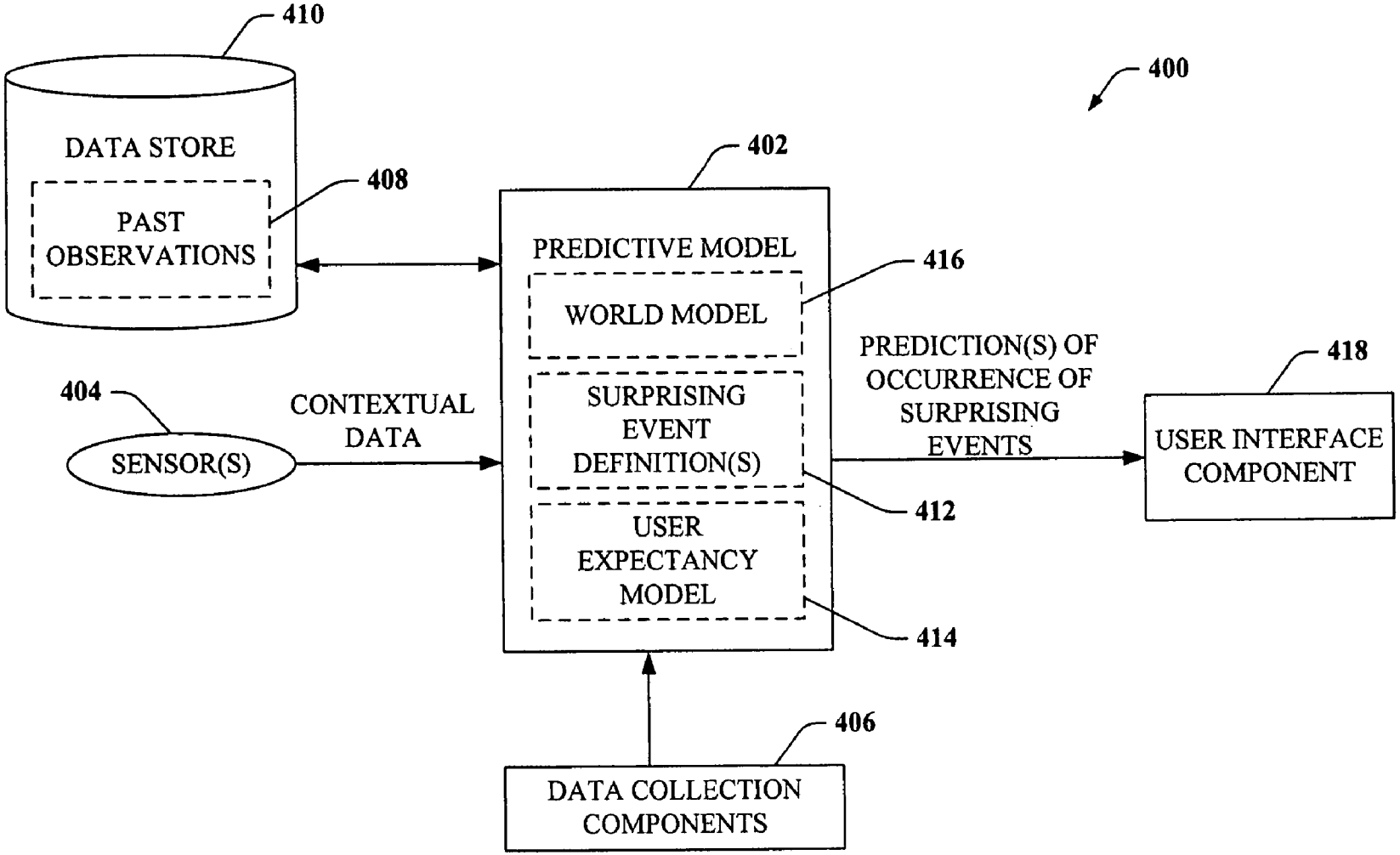
FIG. 4 is a block diagram of a system that facilitates generating predictions of surprising events.

Turning now to FIG. 4, a system 400 that facilitates predicting surprising events (and/or atypical or anomalous situations) that may occur in the future and providing such predictions to a user is illustrated. The system 400 includes a predictive model 402 that can predict occurrences of surprising events in the future, timing associated therewith, and probabilities associated therewith. The predictive model 402 can generate predictions as a function of contextual data received from sensor(s) 404 and data collection components 406, which can be similar devices to those described with respect to FIG. 2. Moreover, the predictive model 402 can output predictions of surprising events that may occur in the future as a function of past observations 408 that are resident within a data store 410. The data store can be any suitable data storage mechanism, such as a conventional hard disk, a removable disk, flash memory, etc.

In one example, the predictive model 402 can include surprising event definition(s) 412, which enable the predictive model 402 to differentiate between typical or unsurprising events and atypical or surprising events. For instance, the predictive model 402 can generate predictions relating to future events that are not surprising to a user, and thus not desirably reviewed by a user. If the predictive model 402, however, generates a prediction in accord with the surprising event definition(s) 412, then a prediction of a surprising event can be output to the user. In another example, the surprising event definition(s) 412 can be updated and or supported by a comparison between outputs of a user expectancy model 414 and a world model 416. The user expectancy model 414 can emulate manners in which typical users make predictions, which tend to be simple correlations between a limited number of variables. Thus, a surprising event can be defined as an event that lies outside consideration or expectancy of the user expectancy model 414. The world model 416 can be a more complex, probabilistic model that takes into consideration a greater number of variables and relation therebetween, wherein a substantial number of such variables and relations are often not contemplated by a typical observer when generating a prediction. Thus, given substantially similar contextual and historical data, the world model 416 and the user expectancy model 414 can output vastly different future predictions. When this occurs, the surprising event definition(s) 412 can be updated with the event, and a user can be provided with a prediction of the possible surprising event by way of a user interface component 418. Furthermore, to increase efficiency and performance of the predictive model 402, data collected by the sensor(s) 404 and data collection components 406, as well as predictions of events associated therewith and actual events can be stored in the data store 410 as past observations 408. Accordingly, over time, the predictive model 402 can become increasingly accurate.

To more fully describe the user expectancy model 414, an example relating to traffic is provided herein. The user expectancy model can be built utilizing marginal statistics describing status of particular locations in a road system for particular segments of time within days of the week, thereby creating marginal models. Such models can be conditioned on a subset of variables that one or more machine-learning procedures consider (together with time of day and day of week), such as weather and holiday status. Such data is readily available to commuters. To identify surprises relating to traffic, output of the marginal models (which make up the user-expectancy model 414) can be compared with real-time states and/or outputs of the world model 416 (which contemplates more variables and interdependencies therebetween).

Figure 5:
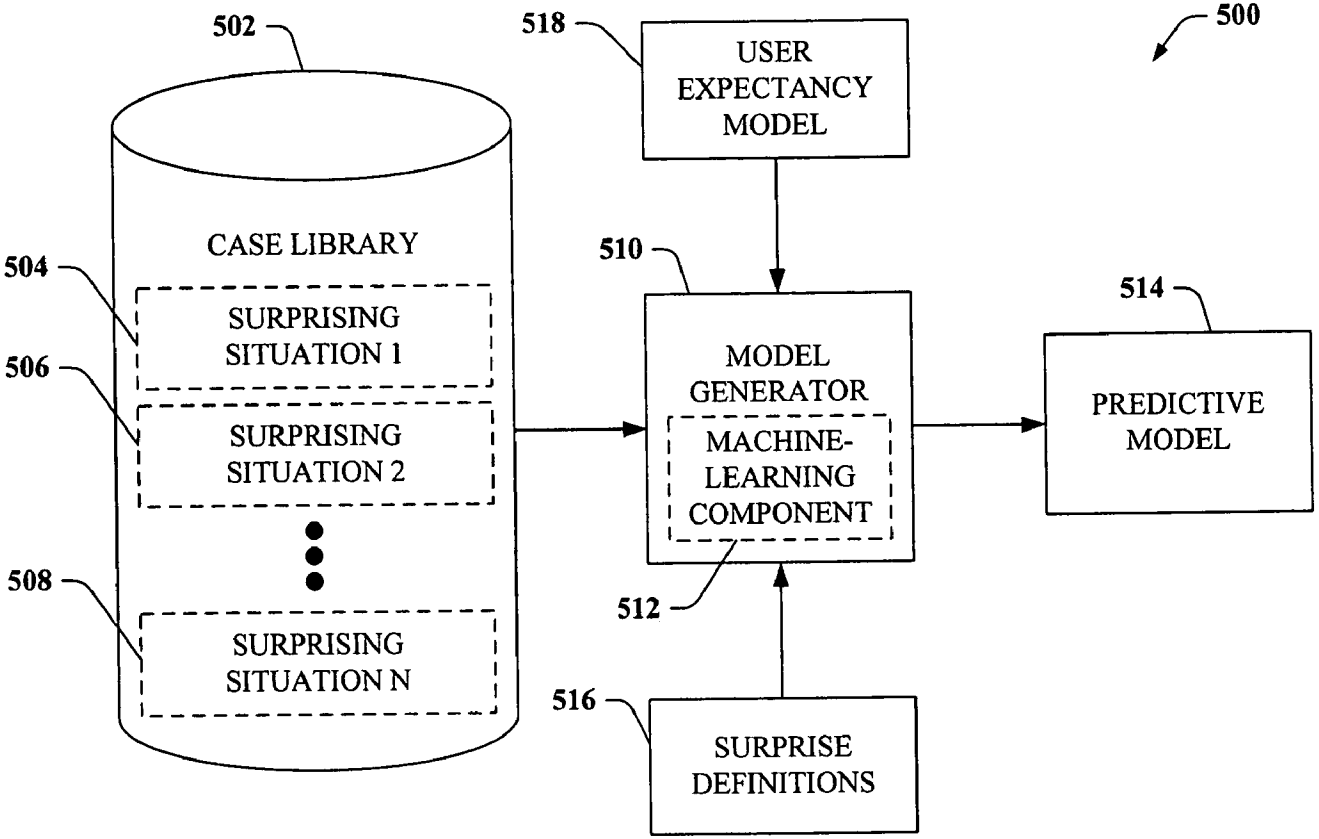
FIG. 5 is a block diagram of a system that facilitates building a predictive model that can predict future occurrences of surprising events.

Now turning to FIG. 5, a system 500 that facilitates building a predictive model that can generate predictions of surprising events that may occur in the future is illustrated. The system 500 includes a case library 502, which can comprise a plurality of surprising situations 504-508, which can be represented by data (e.g., status and interdependencies of variables, . . . ). For example, the case library 502 (or a plurality of libraries) can be focused upon surprising events that are considered to likely influence utility of an observer in a positive or negative way. Moreover, the surprising situations 504-508 can be of poorly characterized utility. In another approach, the case library 502 includes cases where outcome is outside a probabilistic distribution. In other words, cases can be identified where, for example, unexpected or surprising volumes of traffic are existent on particular portions of a roadway, and where volume is a threshold number of standard deviations above or below a mean amount of traffic, and such cases can be stored within the case library as the surprising situations 504-508. In an example relating to traffic congestion, traffic data, time of day, day of week, whether a holiday is in progress, whether school is in session, start and stop time of large-scale events in a region, such as sporting events, synchronized information regarding weather, including status of precipitation, visibility, temperature, and amount of sunshine. For instance, this information can be gathered from sources on the Internet and/or by way of sensors. Any suitable manner for constructing the case library 502 and classifying the situations therein, however, is contemplated.

Further, data proximate in time to surprising situations 504-508 can be stored within the case library 502. In more detail, observations relating to the surprising situations 504-508 can be coupled with the surprising events within the case library 502. For instance, in a traffic application, observations obtained in advance of the surprising situations 504-508 can be obtained, including observations relating to weather, incident reports, major events (e.g., sporting events), status of observations relating to history of traffic flow throughout a particular traffic system, and the like. A time threshold can be defined, and observations within such time threshold can be obtained.

Contents of the case library 502 can be delivered to a model generator 510 that utilizes a machine-learning component 512 to assist in creating a predictive model 514, wherein the model 514 is utilized to predict future occurrences of events and/or states, including surprising situations. For instance, the machine-learning component 512 can relate to Bayesian network models, statistical classifiers, neural net methods constructed by way of structure search and parameter optimization to design the predictive model 514. The model generator 510, utilizing such techniques, can generate a graphical view into the predictive model 514, thereby providing a graphical view to model (and enabling an individual to visualize multiple variables and influences). In one example, rather than building a model for a plurality of disparate locations (e.g., different traffic bottlenecks), the model generator 510 can construct the predictive model 514 so that it captures interdependencies among multiple locations and variables. Referring to traffic, utilizing such an approach can enable the predictive model 514 to learn about dependencies and temporal relationships among flow through bottlenecks. The model generator can further receive anomaly definitions 516, which can be associated with the surprising situations 504-508, and incorporate these definitions 516 into the predictive model 514. Moreover, a user expectancy model 518 can be generated and provided to the model generator 510, so that predictive outputs relating to the anomaly definitions 516 can be compared with expected outputs generated by way of the user expectancy model 518. Thus, the predictive model 514 can include various mechanisms for defining surprising events as well as outputting predictions of future surprising events and probabilities associated therewith.

Referring now to FIGS. 6-9, methodologies in accordance with the claimed subject matter will now be described by way of a series of acts. It is to be understood and appreciated that the claimed matter is not limited by the order of acts, as some acts may occur in different orders and/or concurrently with other acts from that shown and described herein. For example, those skilled in the art will understand and appreciate that a methodology could alternatively be represented as a series of interrelated states or events, such as in a state diagram. Moreover, not all illustrated acts may be required to implement a methodology in accordance with the claimed subject matter.

Figure 6:
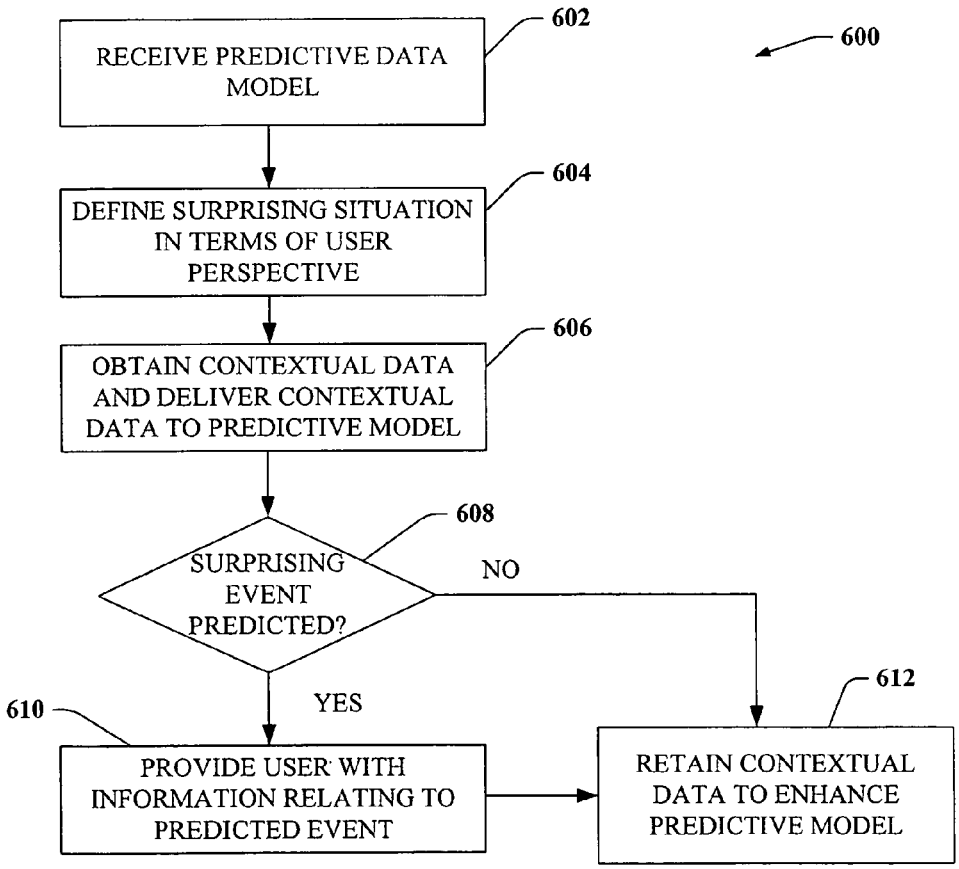
FIG. 6 is a flow diagram illustrating a methodology for predicting future occurrences of events that would be surprising to a user.

Turning solely to FIG. 6, a methodology 600 for generating predictions from a predictive model is illustrated. At 602, a predictive data model is received. Such model can include, for example, one or more Bayesian networks, utilize neural networks or fuzzy logic, and any other suitable form of machine learning. Moreover, the predictive data model can be generated as a function of historical data, user expectancies, and the like. At 604, definitions are provided for surprising instances. Generating such definitions has been described in detail above. At 606, contextual data is obtained and delivered to the predictive model. Such data can be obtained from sensors, web sites, radio, or any other suitable location of information. For instance, information can be obtained directly from a dialog with a user. At 608, a determination is made regarding whether a surprising event has been predicted. If the surprising event has been predicted, then at 610 a user is provided with information relating to the predicted event. For example, in a traffic context, if a congestion that would be surprising to a user is predicted to occur in the future, the user can be provided with location of the predicted congestion, time of occurrence of the predicted congestion, time predicted to clear the congestion, and probabilities associated with correctness of the aforementioned predictions. The predictions and contextual data can then be retained at 612 to improve the predictive model. If a surprising event has not been predicted at 608, then the contextual data collected can be retained to improve performance of the model.

Figure 7:
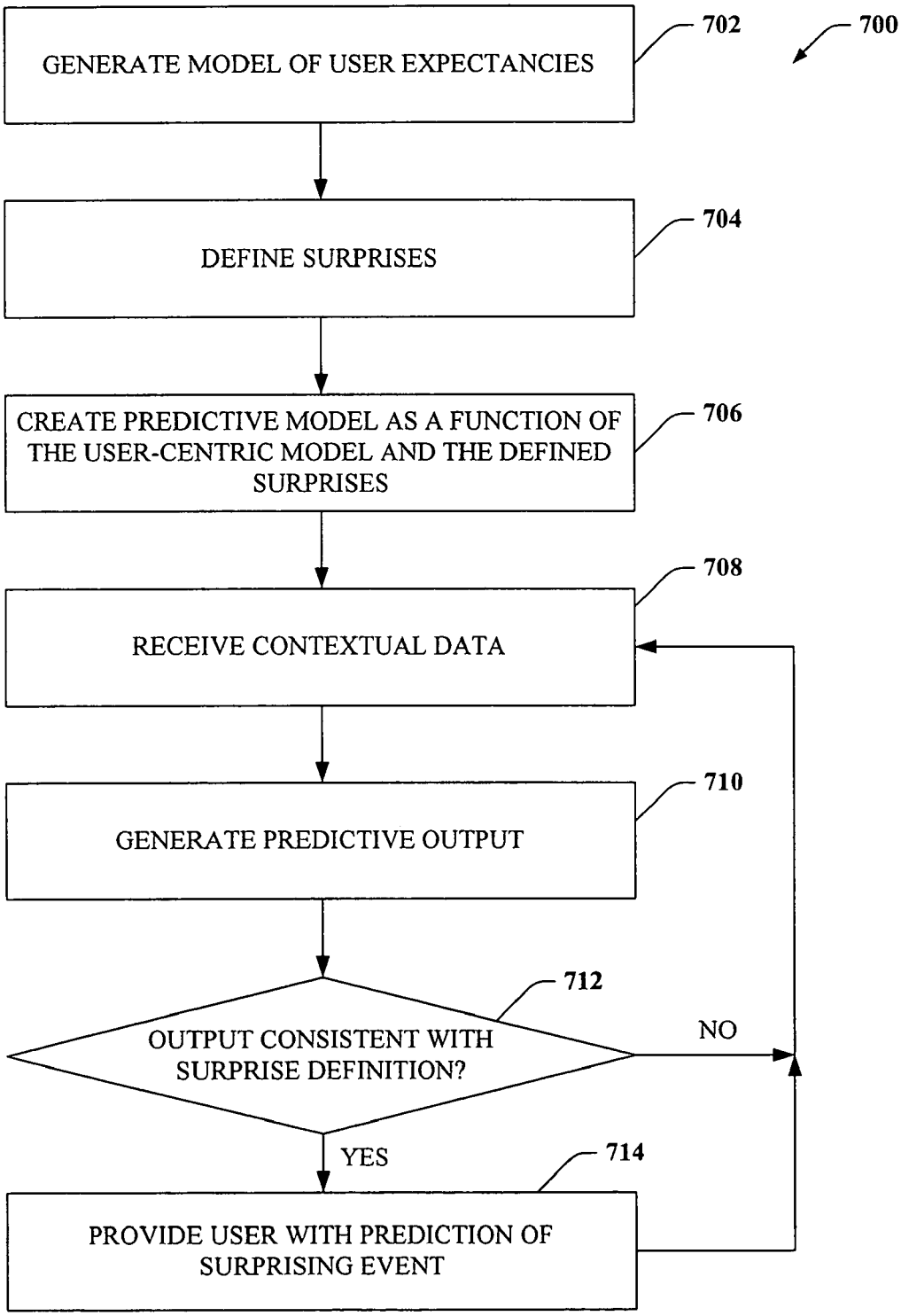
FIG. 7 is a flow diagram illustrating a methodology for predicting future occurrences of surprising events.

Turning now to FIG. 7, a methodology 700 for predicting surprising events that may occur in the future is illustrated. At 702, a model of user expectancies is generated. For instance, the model can sufficiently imitate manners in which humans tend to generate predictions for future occurrences, which is typically simply noting a select number of variables and recognizing low-level interdependencies between the variables. For instance, if extreme weather conditions exist, the user can predict that particular portions of roadways will be subject to congestion. A user will often not recognize complex interdependencies, however. For example, an accident on a first roadway can affect congestion in traffic on a second roadway that is traveled by a user. Such user may not know of the accident, and may further not recognize a relationship between the accident and congestion on the currently or desirably traveled roadway.

At 704, surprising events are defined. These events can be defined as events not considered by the user-expectancy model, events that are outside a threshold probability of occurring, user-selected events, occurrences that are a particular number of standard deviations away from a mean, or any other suitable manner for defining surprising events. Examples of these events can be retrieved from a case library and utilized in connection with generating a model that predicts surprising events that may occur in the future. At 706, a predictive model is created as a function of the user-centric model and the defined surprises. In particular, the predictive model can analyze outputs of the user-centric model and compare such output against an output of a more robust model—if there are great discrepancies therebetween, then a user can be alerted of a surprising event. Furthermore, if the predictive model creates an output that is substantially similar to a defined surprising event, then a user can be alerted of such event. The predictive model can be created in such a manner to enable output of the aforementioned surprising events.

At 708, contextual data is received. For instance, this data can be received by way of sensors (e.g., on a roadway), camera, GPS systems, text-recognition components, web-crawlers, voice analysis components, or any other suitable means for obtaining/receiving contextual data. At 710, the predictive model generates a predictive output. At 712, a determination is made regarding whether the output is consistent with the definitions of surprises. If the output is not consistent with the surprise definitions (e.g., the prediction does not relate to a surprising event), then contextual data can be received at 708. If the output at 712 is consistent with a surprise definition, then a user can be provided with prediction if a surprising event at 714. For example, the user can be alerted as to unexpected congestion upon a roadway, unexpected sales numbers, etc. Upon providing the user with information relating to a predicted surprising event, contextual data can be received at 708.

Figure 8:
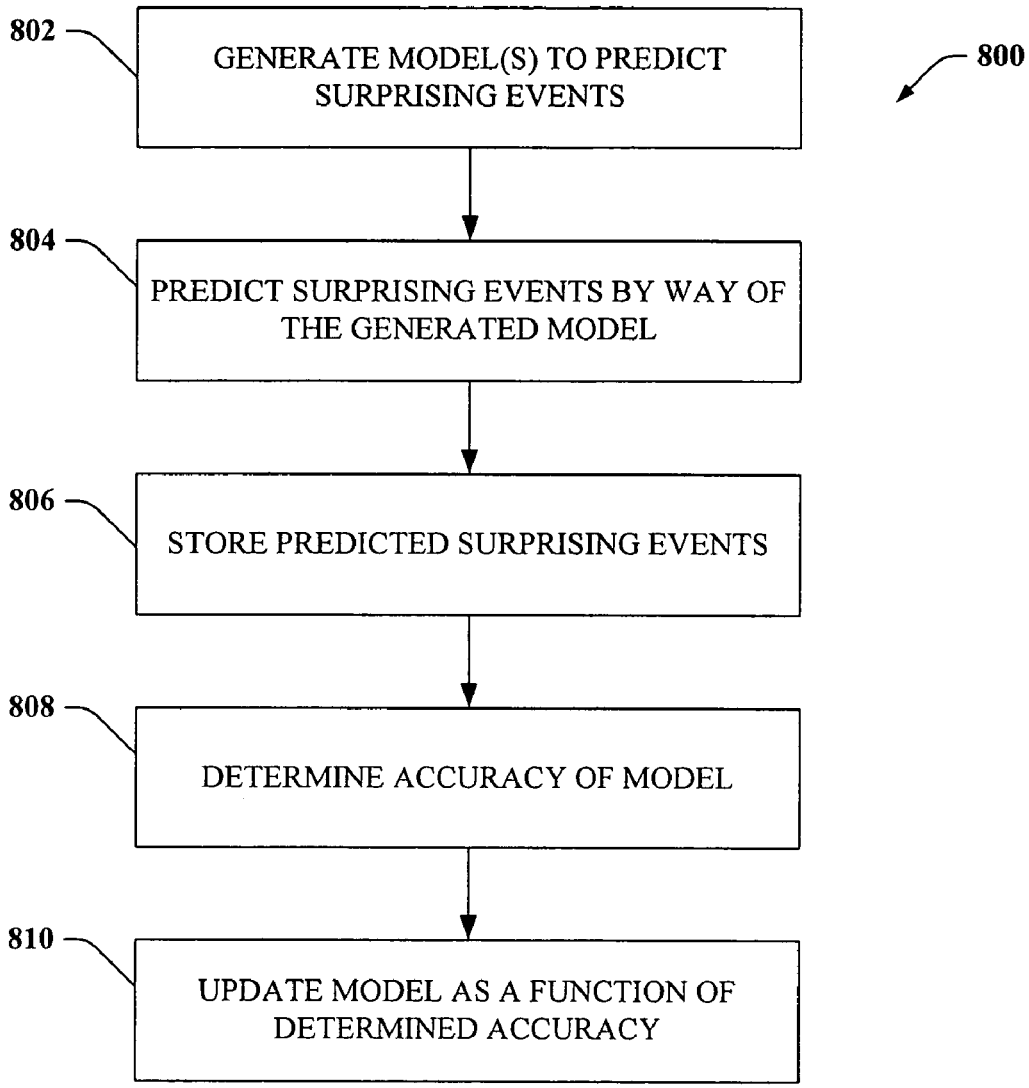
FIG. 8 is a flow diagram illustrating a methodology for automatically updating a predictive model.

Referring now to FIG. 8, a methodology for refining a predictive model that predicts future surprising events is illustrated. At 802, model(s) that are employed to predict surprising events are generated. As described infra, these models can be built as a function of case studies that describe surprising events. Furthermore, the models can be generated as a function of surprise definitions. At 804, surprising events are predicted by way of the generated model. In a traffic application, points of congestion can be predicted wherein such congestion may or may not be a surprise. At 806, predictions output by the predictive model are stored. At 808, accuracy of the model is determined. This can be accomplished by comparing predictions output by the model with actual events. In a particular example, the predictive model can predict that traffic will be congested at a particular portion of a roadway at a certain time, and will remain congested for a particular period of time. These predictions can be compared with actual results, wherein the results can be obtained by way of sensors and/or user input. At 810, the model is updated as a function of the determined accuracy. Thus, if the model is consistently incorrect, such model can be tuned accordingly. Various machine-learning mechanisms/techniques can be employed in connection with automatically tuning the predictive model.

Figure 9:
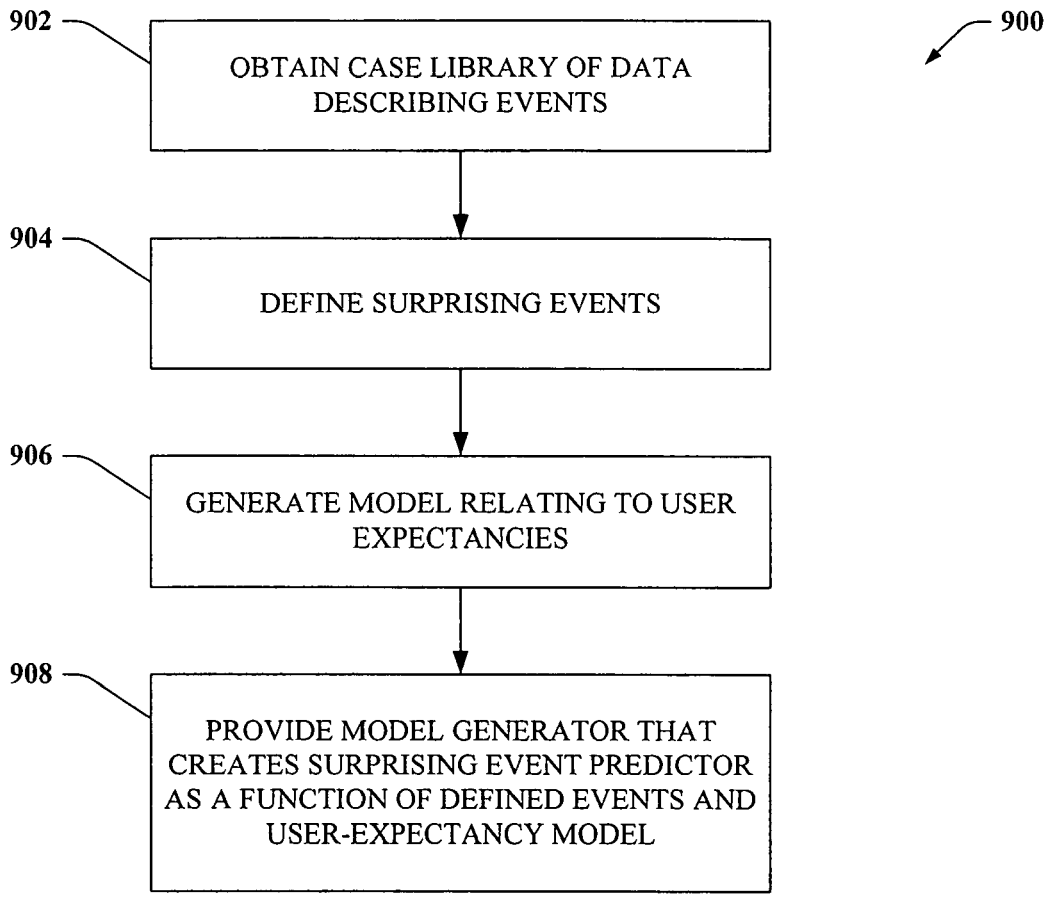
FIG. 9 is a flow diagram illustrating a methodology for creating a predictive model that can predict future occurrences of surprising events.

Turning now to FIG. 9, a methodology 900 for generating a model that can predict surprising events is illustrated. At 902, a case library of data describing events is obtained. For instance, the case library can include events that are defined as surprising events, typical events, or any other suitable events. At 904, surprising events are defined. In one example, events not contemplated by a simplistic user-centric model can be defined as surprising events. In another example, events that lie outside a particular probability range or a particular number of standard deviations away from a mean can be defined as surprising events. As can be determined from the above, any suitable manner for defining surprise is contemplated by the inventor and intended to fall under the scope of the hereto-appended claims.

At 906, a model is generated and/or provided that generates predictions according to user expectancies. Thus, the model is designed to take into account variables typically considered by a user and interdependencies between variables typically considered by a user. At 908, a model generator is provided, wherein the model generator creates a surprising event predictor as a function of the defined events and the user-expectancy model. While not described, the created model can include a "world" model, which, given a substantial amount of data, can determine various levels of interdependencies between numerous variables. The "world" model can thus be much more sophisticated than the user-centric model. Accordingly, if the user-centric model outputs predictions markedly disparate from predictions output by the "world" model, outputs of the "world" model can be considered a surprising event. In another example, if the "world" model outputs a prediction that is sufficiently related to a defined surprise, then such prediction can be presented to a user as a surprising event.

Figure 10:
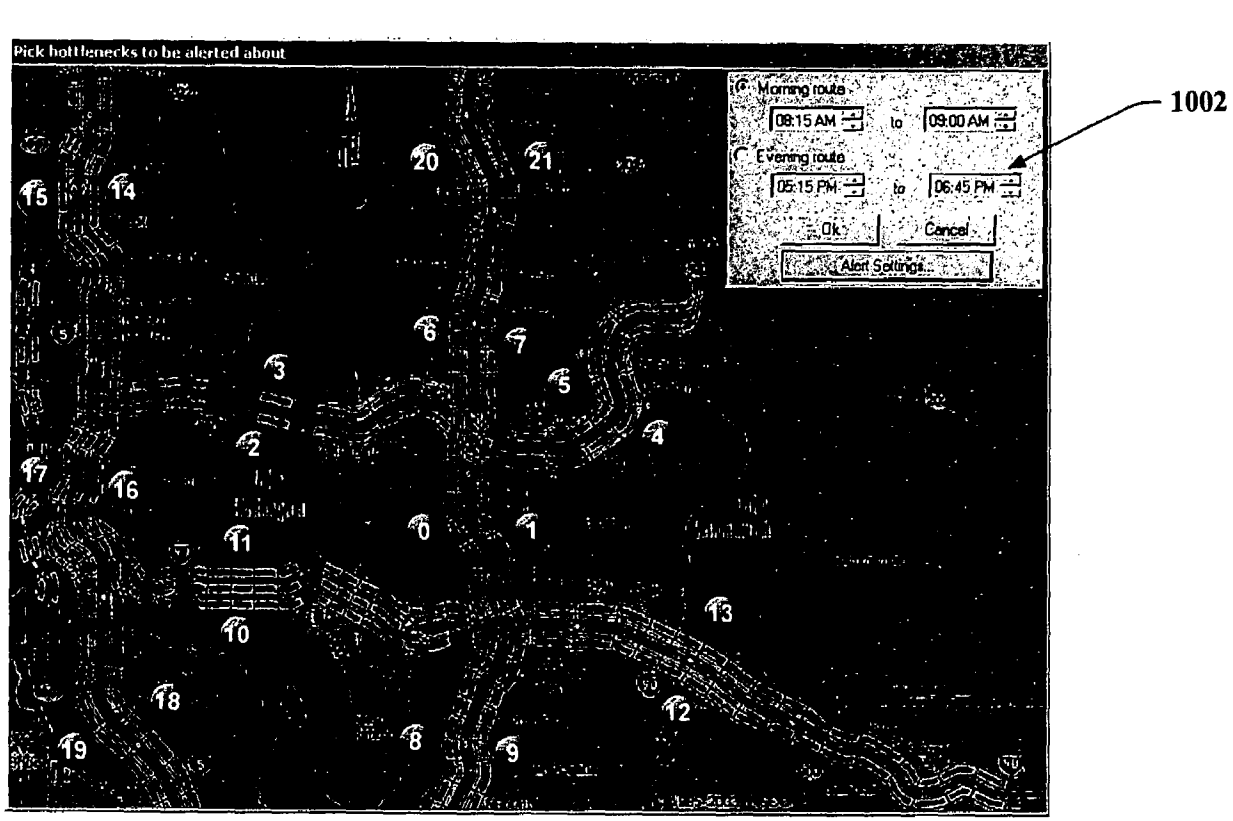
FIG. 10 is an exemplary screenshot of a tool that enables users to customize alerts according to defined routes and times of travel.

Now referring to FIG. 10, a screenshot 1000 that illustrates user-definition of a route to enable route-based alerting is illustrated. For example, utilizing a tool that can display graphical information (similar to that displayed in the screenshot 1000), a user can define routes of interest, for example, relating to morning and evening commutes. In more detail, a user can define route(s) and times associated with a morning commute, route(s) and times associated with an evening route, refresh rates corresponding to a display, and the like. A data-entry and display entity 1002 can be provided to facilitate enablement of such user-definitions. Further, when such a route-based alerting system is enabled, audio alerts can be presented to a user with respect to defined routes at relevant times. For instance, a user can set a threshold level of congestion, and when traffic congestion reaches such threshold and/or is predicted to reach the threshold, then the user can be alerted (e.g., audibly, through vibration of a mobile device, . . . ). Similarly, the user can wish to receive alerts relating to when traffic congestion is below a threshold with respect to a route and a period of time, and/or be alerted as to when traffic congestion is predicted to be below the threshold. Furthermore, a user can set alerts that will be presented that indicate a surprising situation or event. In one example, the user can define routes of travel by specifying where such user travels (as indicated by circled numerals within the screenshot 1000). This selection can be accomplished by way of graphically selecting numerals and/or by manually entering numerals within a data receiving entity.

Figure 11:
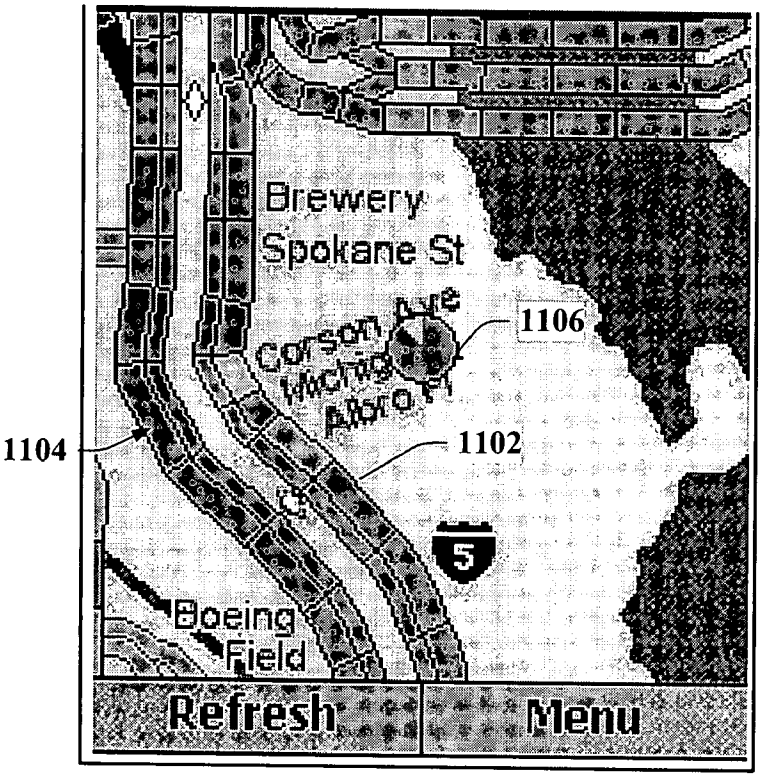
FIGS. 11 and 12 are exemplary screenshots illustrating one or more novel aspects of the claimed subject matter.

Turning now to FIG. 11, a screenshot 1100 of an application that utilizes predictions generated by a predictive model (as described above) is illustrated. The screenshot includes graphical representations of various roadways 1102, wherein the roadways include a plurality of portions 1104. The portions can be associated with a particular color and/or shade of color that indicates a level of congestion associated with the portions. For example, if the portion 1104 is shaded a color of green, a user can determine that there is little congestion upon such portion 1104. The prediction can be provided to a user by way of receipt of contextual data and historic data associated with the roadways 1102. A timing indicator 1106 is also included within the screenshot 1100, wherein such indicator 1106 informs a user of a predicted time associated with a current traffic condition of a selected portion of the roadways 1102. For instance, the timing indicator 1106 can indicate that a lack of congestion will remain for a predicted amount of time, and a probability of correctness can be associated therewith. In another example, the screenshot 1100 can provide a user with information relating to a time in the future. Thus, prior to the user leaving a place of employment, such user can request predicted information relating to a route of travel a certain distance from a current point in time. In still another example, surprise can be provided to the user by way of a predicted model.

Figure 12:
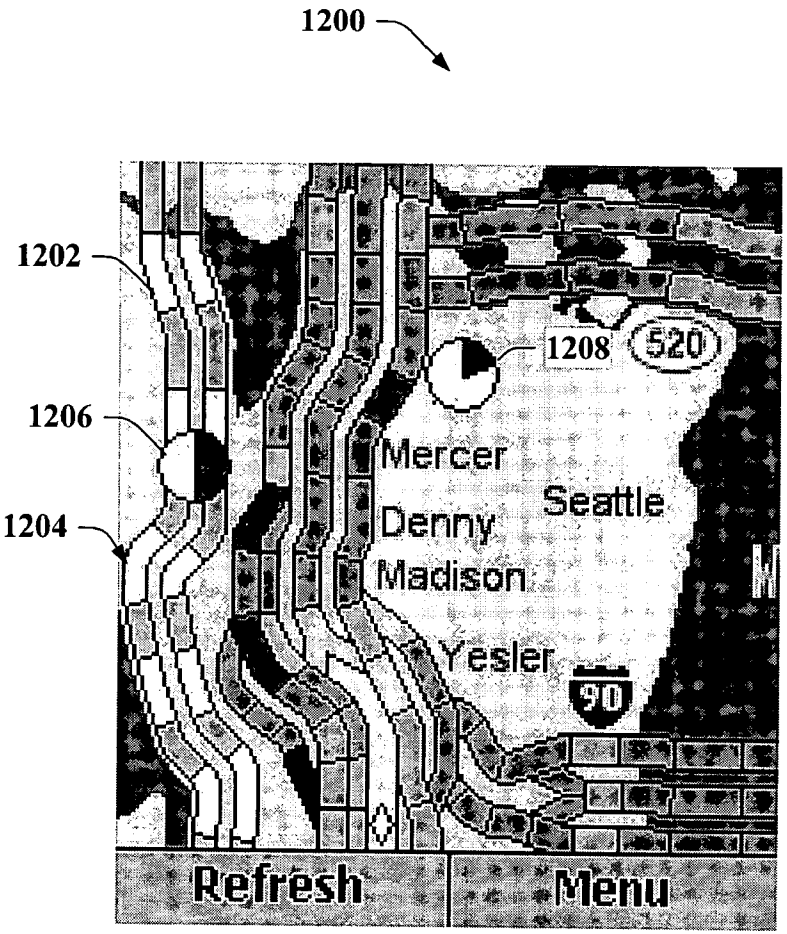

Now referring to FIG. 12, another exemplary screenshot 1200 is illustrated. The screenshot 1200 shows that traffic information can be provided to a user by way of a display. The display can be on a cellular phone, a smart phone, a PDA, a laptop, etc. The screenshot illustrates a plurality of graphically represented roadways 1202, wherein the roadways include graphically represented portions 1204. The portions can be associated with disparate colors and/or disparate shading to convey to a user that certain portions of the roadways 1202 are predicted to be subject to congestion. For example, a portion colored red is subject to high congestion. Timing indicators 1206 and 1208 can be associated with selected portions of the roadways 1202, and can indicate a predicted time until the congestion occurs, a predicted time that the congestion will remain upon a particular portion, and the like. As described above, the prediction can be related to a surprising event. For instance, it may not be typically expected that a certain portion of the roadway 1202 is subject to light congestion at a particular time. A robust predictive model, however, can output such predictions as a function of defined surprising events and user expectancies, as well as received contextual data and historical data.

Figure 13:
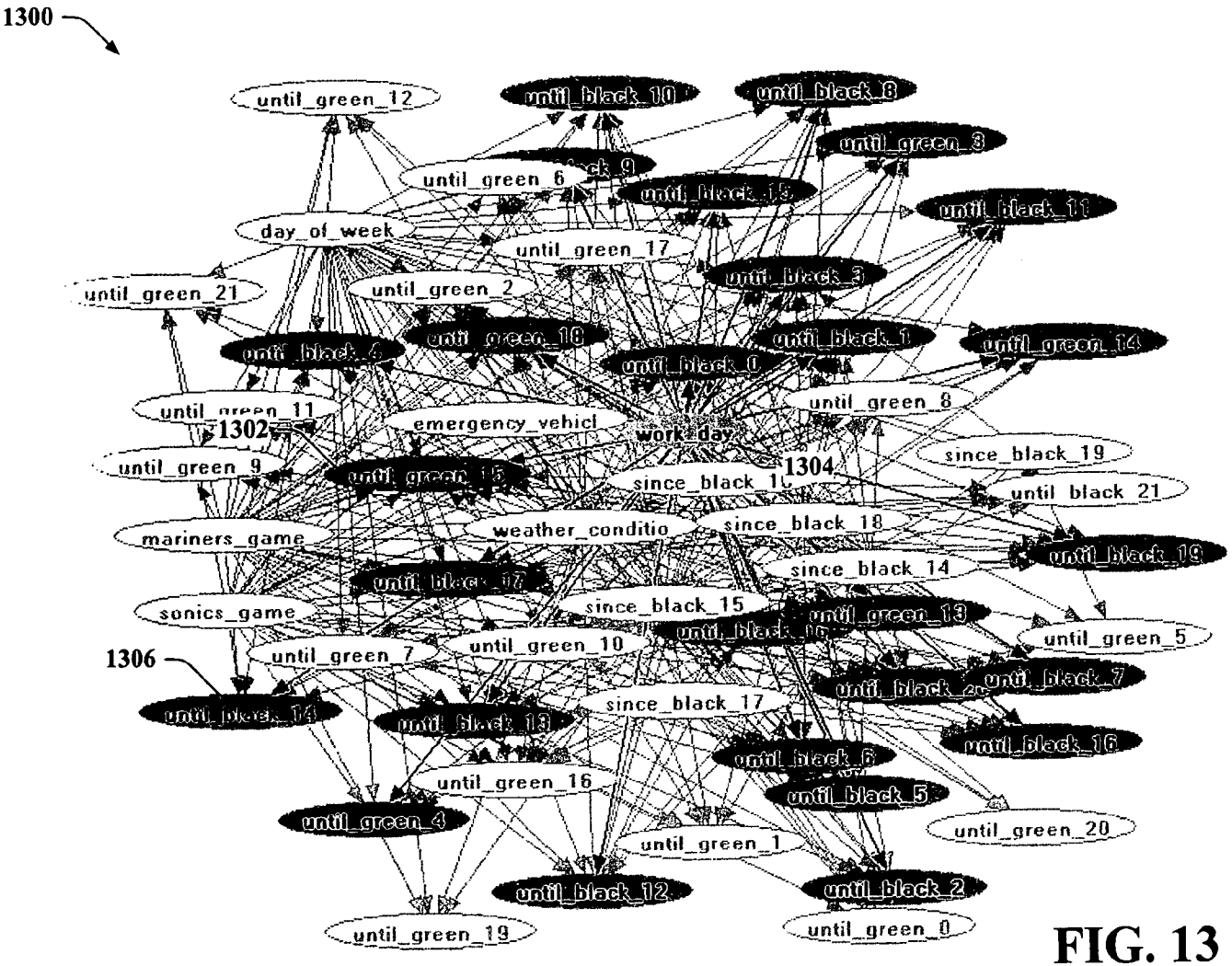
FIGS. 13-16 are exemplary networks illustrating interdependencies between variables utilized in connection with predicting future occurrences of surprising events.
Figure 14:
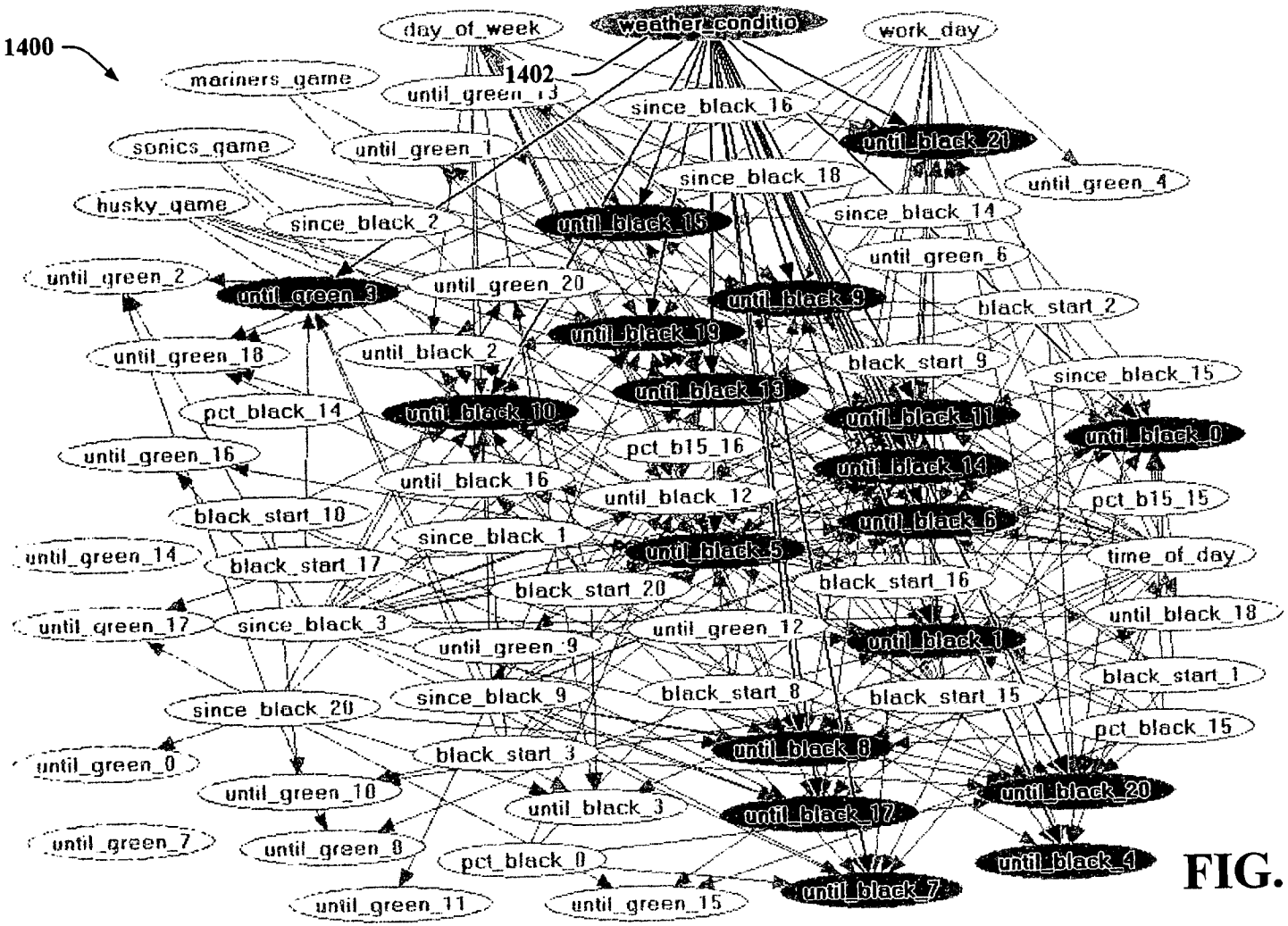
Figure 15:
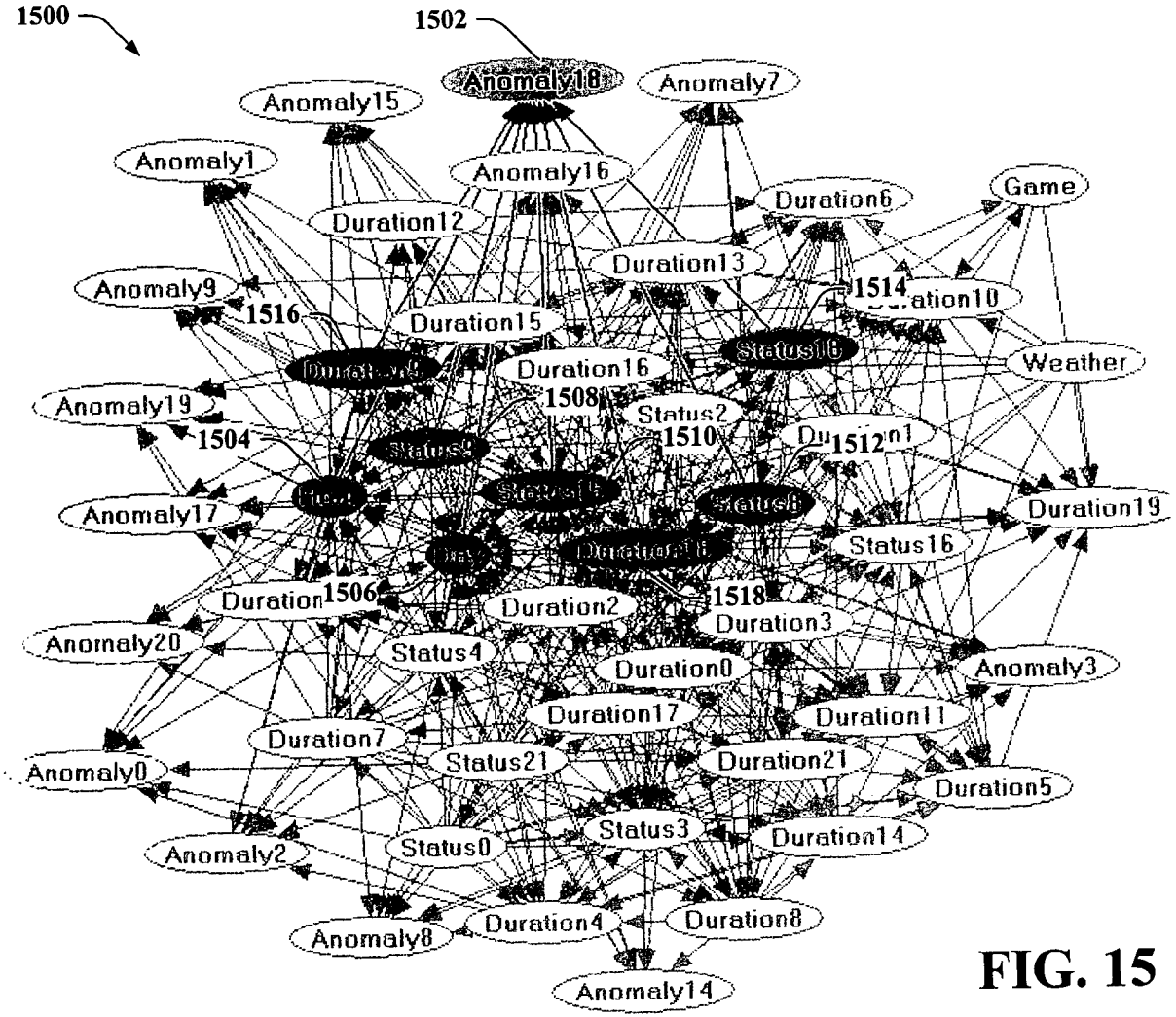

Referring collectively to FIGS. 13-15, graphical representations of networks that illustrate interdependencies between variables and traffic conditions are provided, wherein such state diagrams can be employed in connection with generating a predictive model for predicting future traffic conditions. Turning specifically to FIG. 13, a graphical depiction of an exemplary Bayesian network model 1300 showing interdependencies between a variable representing a workday and timing associated with disparate congestions and disparate portions of roadways is illustrated. In one example, the network model 1300 can be generated by way of structure learning and utilized in connection with predicting parameters relating to traffic. For a specific example, whether or not a day is a workday can affect timing associated with a portion of a road labeled 15 and represented by a node 1302. Thus, a variable, represented by a node 1304, indicates whether a current day is a workday, and such node 1304 is related to a plurality of nodes within the network 1300. In another example, the variable 1304 influences a time until a portion of a roadway (labeled as portion 14) represented by a node 1306 is no longer heavily congested. Various other interdependencies exist and can be easily discerned upon review of the network model 1300. A calendar application or other mechanism can determine a value for the node 1304 (e.g., a first value can be utilized to represent that a certain day is a workday, and a second value can be utilized to represent that a certain day is not a workday).

Now referring to FIG. 14, an exemplary network model 1400 that is illustrated. The network model 1400 is provided to illustrate influence of a weather variable 1402 (representing mutually exclusive sets of states about weather conditions) on other variables the model 1400. For example, variables capturing an amount of time until bottlenecks will become highly congested if they are currently not highly congested, and an amount of time until bottlenecks will become uncongested if they are currently highly congested.

Turning now to FIG. 15, an exemplary network model 1500 that shows interdependencies between a plurality of variables and surprises is illustrated. The network model 1500 includes a node 1502 that represents a certain defined surprise within a predictive model, and disparate variables that are related to such node 1502. In this example, variables representing time of day (node 1504) and day of week (node 1506) are related to occurrence of a surprise represented by the node 1502. Moreover, status (e.g., congested, partially congested, . . . ) of particular portions of a roadway can be represented by nodes 1508-1514, and the status is shown as being related to predicted occurrence of a defined surprise represented by the node 1502. Further, nodes 1516-1518 representing actual and/or predicted duration of congestion of particular portions of a road are related to the node 1502. These interdependencies between variables can be utilized to generate predictions relating to traffic conditions and/or predict occurrence of future surprising event(s).

Figure 16:
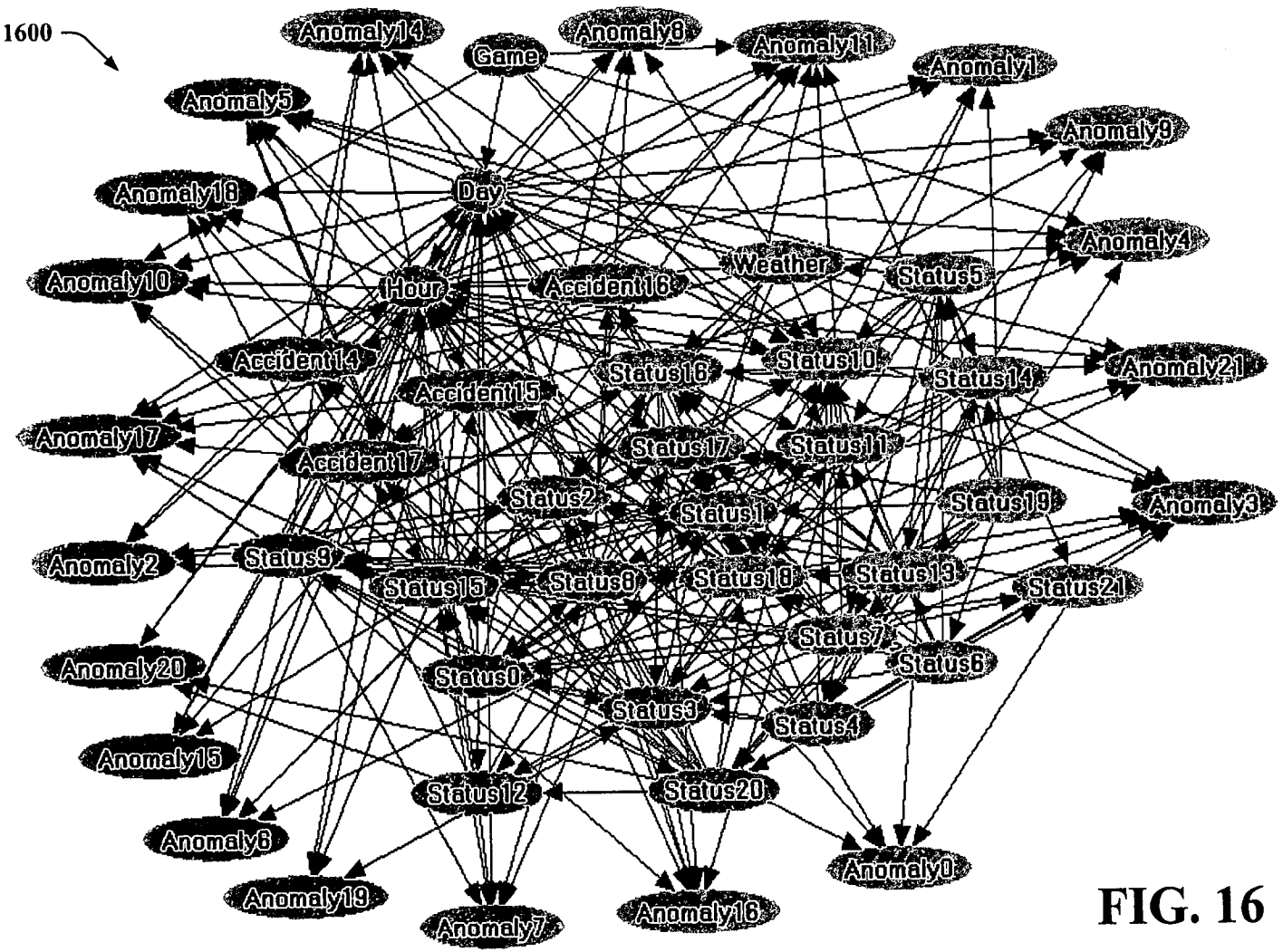

Turning briefly to FIG. 16, a network 1600 illustrating interdependencies between variables and surprising events that can be predicted by a predictive model as described herein is shown. For example, the network includes nodes representing weather, accidents in particular regions of roadways, congestion status within roadways, time of day, day of week, whether there is a sporting event or game, and the like. Thus, the network 1600 can be associated with a robust predictive model that predict traffic patterns generally, and surprising traffic patterns that may occur in the future specifically.

Figure 17:
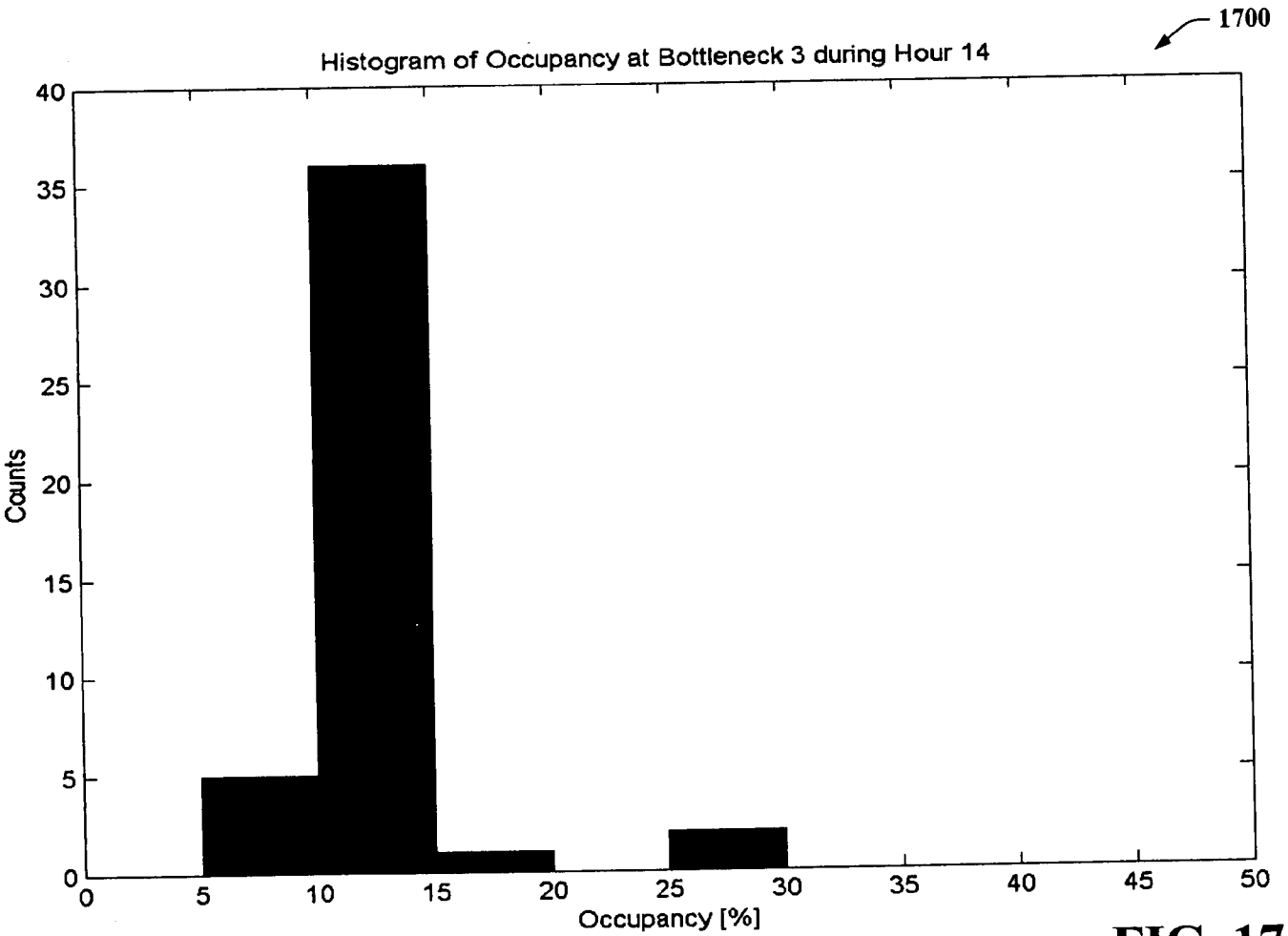
FIGS. 17 and 18 are exemplary graphs illustrating historical data that can be utilized in connection with one or more aspects of the claimed subject matter.
Figure 18:
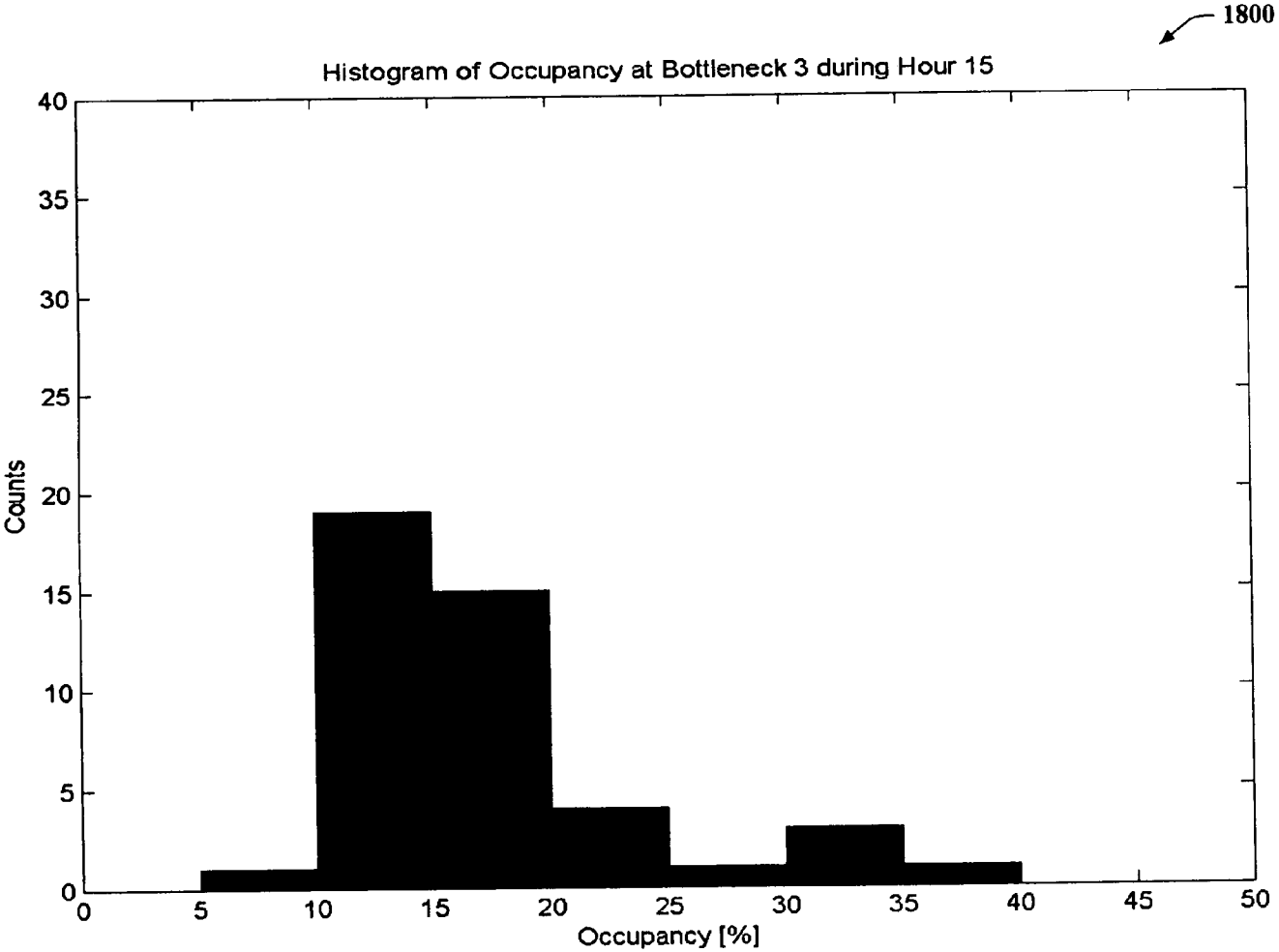

Now referring to FIGS. 17 and 18 collectively, graphs 1700 and 1800 of historical data associated with a particular portion (or bottleneck) of a roadway is illustrated. The historical data that is the basis of the graphs 1700 and 1800 can be utilized in connection with generating a predictive model and outputting predictions therefrom. The axes of the graphs 1700 and 1800 relate to percent occupancy of a particular portion of road and collected data associated therewith at disparate hours of a day.

Figure 19:
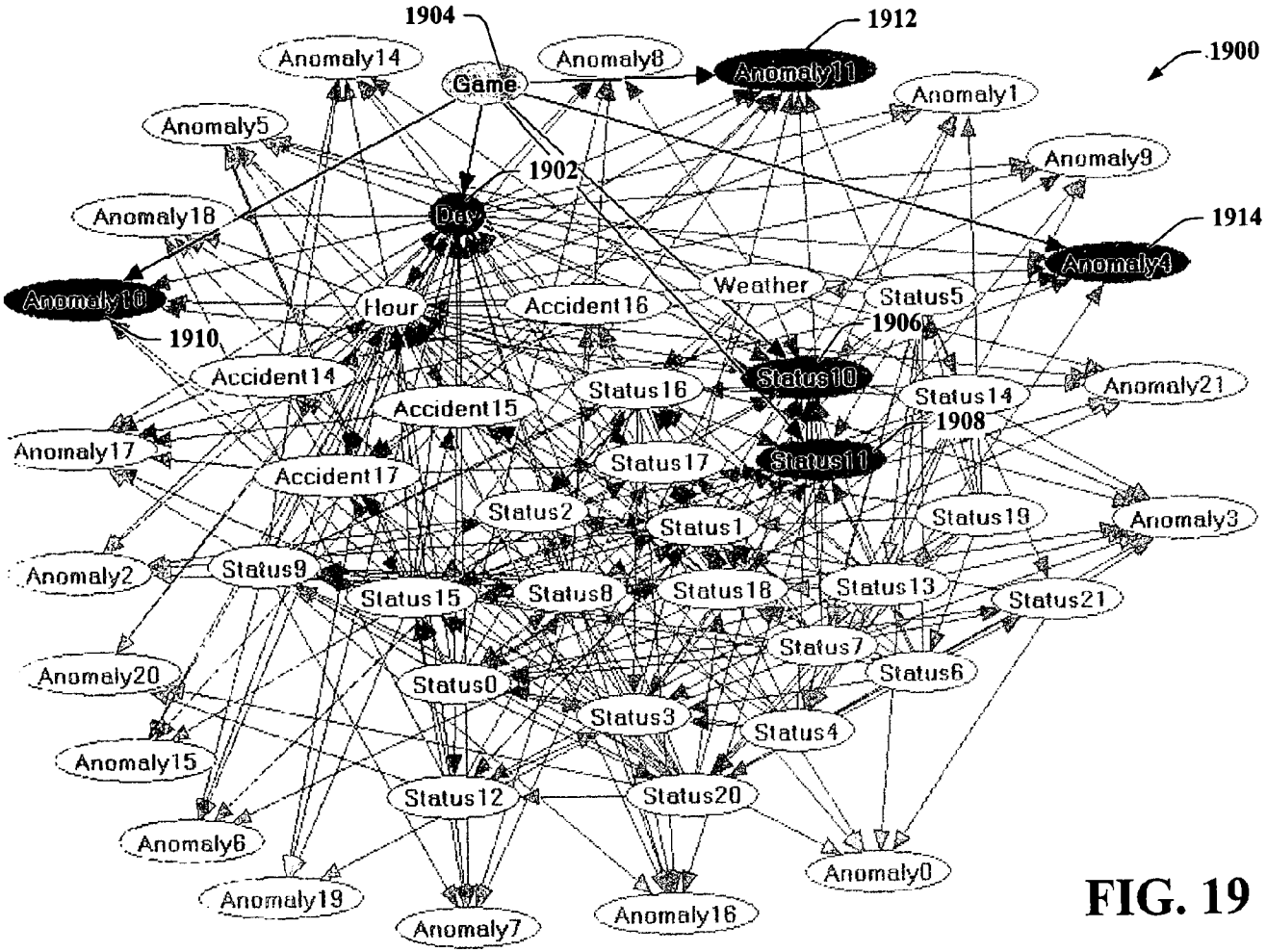
FIG. 19 is an exemplary network illustrating interdependencies between variables utilized in connection with predicting occurrences of surprising.
Figure 20:
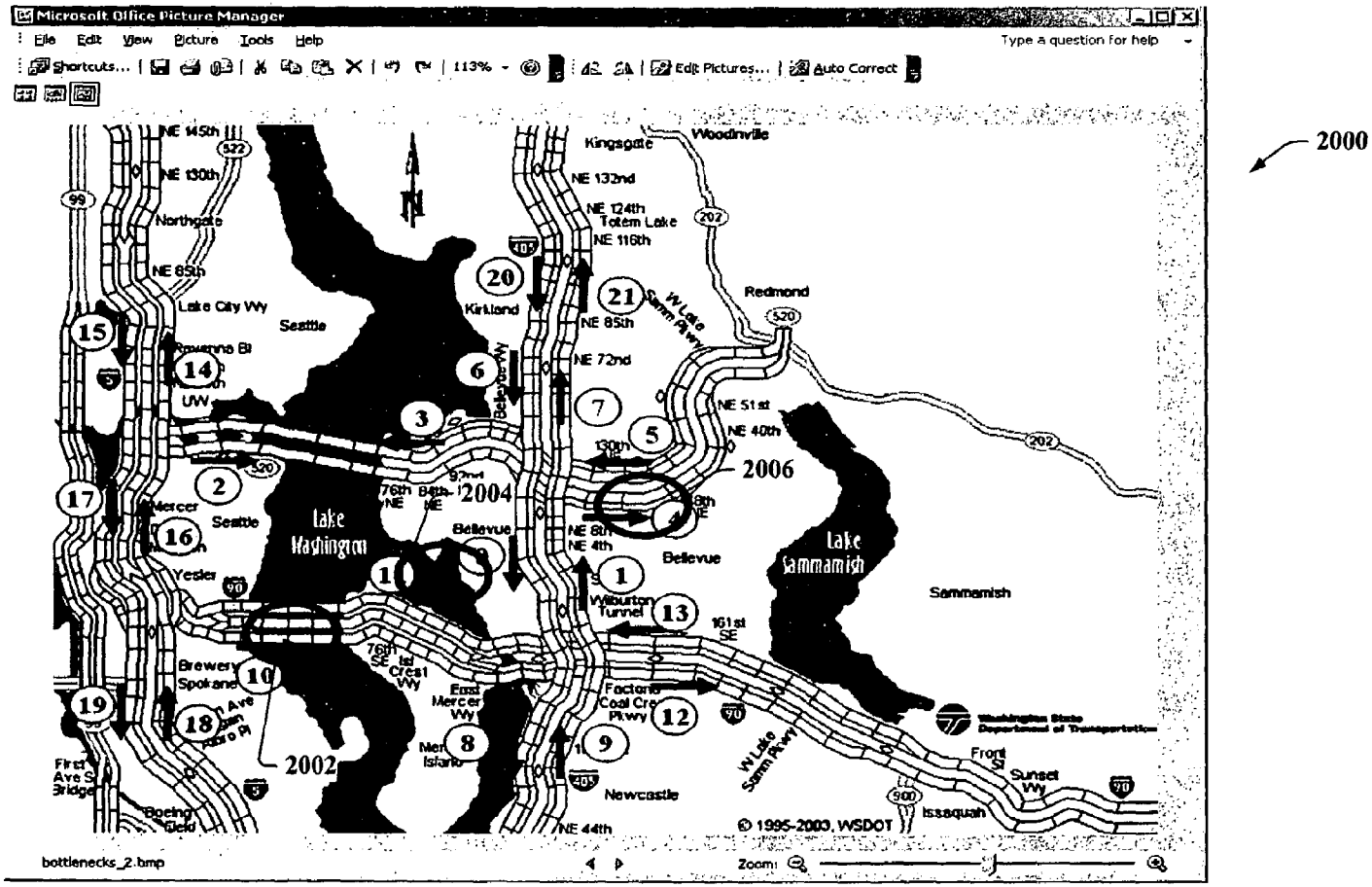
FIG. 20 is a screenshot illustrating a practical application of one or more aspects of the claimed subject matter.

Turning to FIG. 19, a network 1900 that illustrates interdependencies between variables associated with traffic and relation thereof to traffic surprises is provided. For example, a node 1902 representing a day of week, a node 1904 representing whether there is a sporting event, and nodes 1906-1908 representing status of traffic at particular portions of a roadway (labeled 10 and 11, respectively) all relate in one form or another (either directly or indirectly) to surprising traffic conditions at portions of the roadway(s) labeled 10, 11, and 4 (represented by nodes 1910, 1912, and 1914, respectively). Referring now to FIG. 20, a screenshot 2000 illustrating associated surprises (shown in FIG. 19) is provided. Circles 2002, 2004, and 2006 represent surprising traffic conditions at portions 10, 11, and 4, respectively. In this example, the screenshot 2000 illustrates that surprises at first and second portions 2002 and 2004 of a first roadway relate to a surprise at an apparently unrelated portion of a second roadway. Thus, a predictive model utilized to generate the predicted surprises can account for relationships typically not comprehended by individuals.

Figure 21:
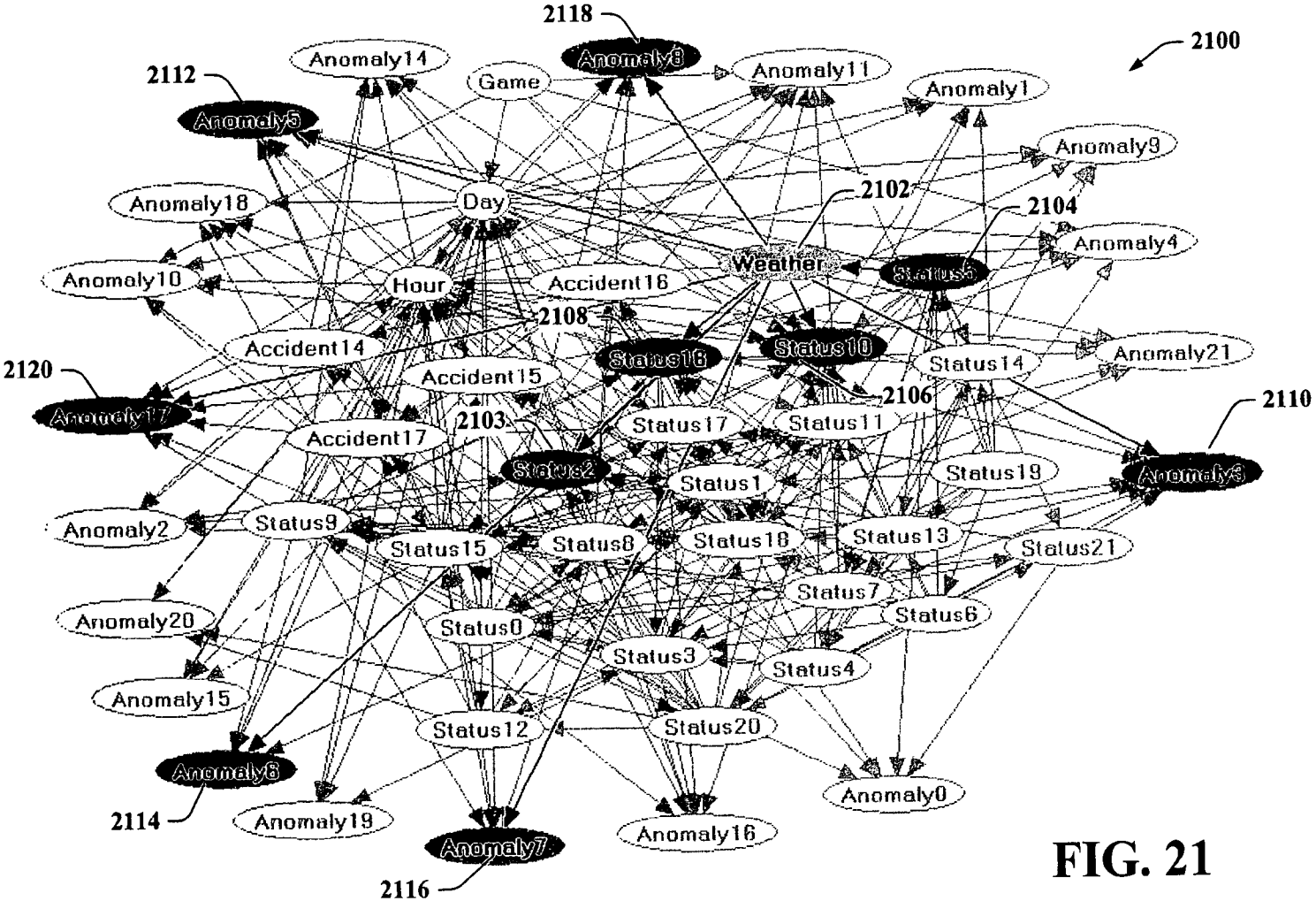
FIG. 21 is an exemplary network illustrating interdependencies between variables utilized in connection with predicting occurrences of surprising events.
Figure 22:
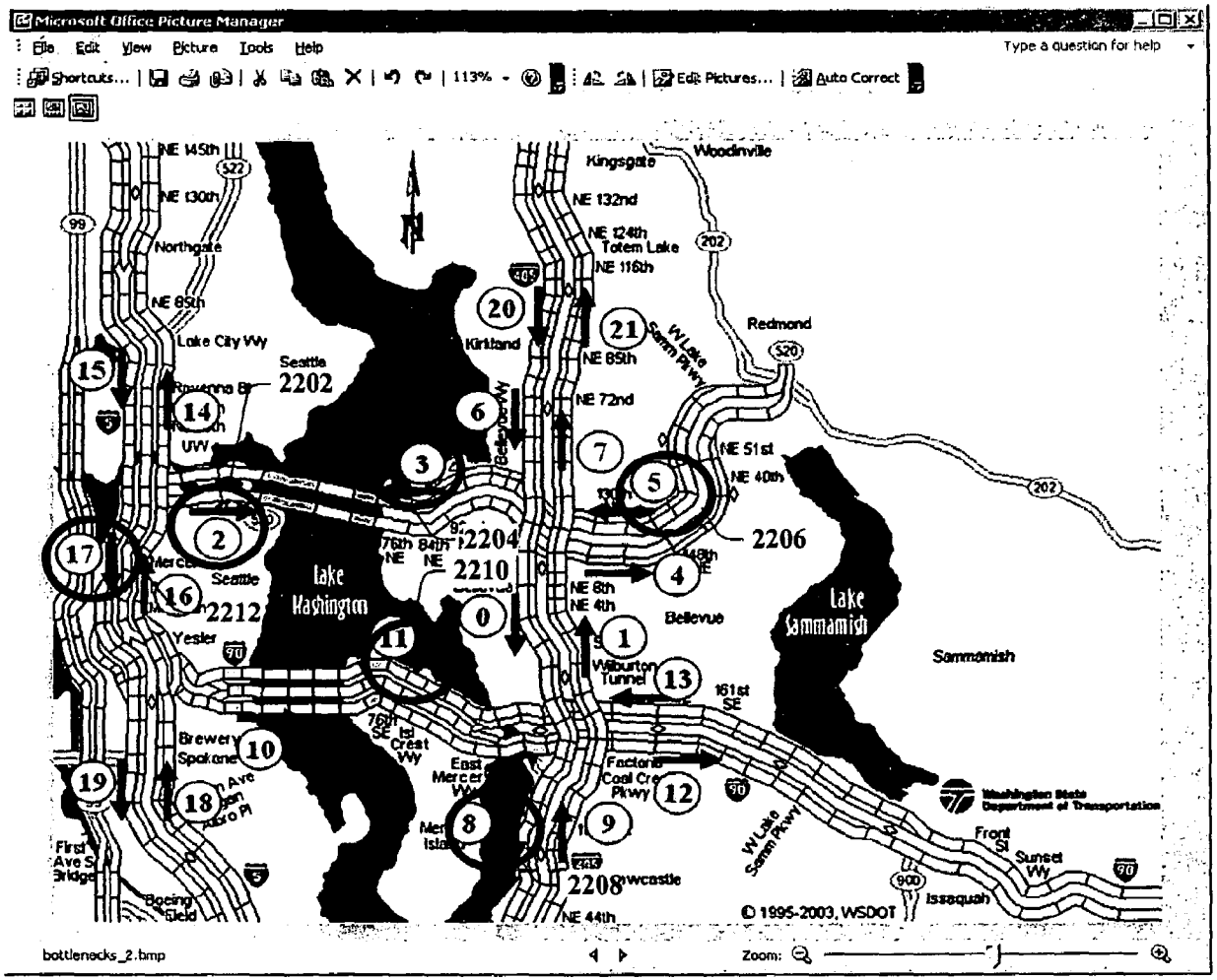
FIG. 22 is a screenshot illustrating a practical application of one or more aspects of the claimed subject matter.

Now referring to FIG. 21, a network 2100 that contemplates interdependencies between variables in association with predicting occurrences of future traffic surprises is illustrated. The network 2100 illustrates that various surprises are interrelated, and that weather and status at particular portions of roadways also relate to possible surprises. In particular, a node 2102 representing weather conditions, and nodes 2103-2108 representing traffic status at disparate portions of roadway (portions 2, 5, 10, and 16, respectively) are all related, directly or indirectly, to nodes 2110-2120 that represent surprises at portions of roadway (portions 3, 5-8, and 17, respectively). Referring briefly to FIG. 22, a screenshot 2200 illustrating locations of the surprises referred to with respect to FIG. 21 are shown. The screenshot 2200 includes circles 2202-2212 that represent portions 2, 3, 5, 8, 11, and 17, respectively. The circles represent exemplary surprises and status of traffic congestion with respect to the network 2100.

Figure 23:
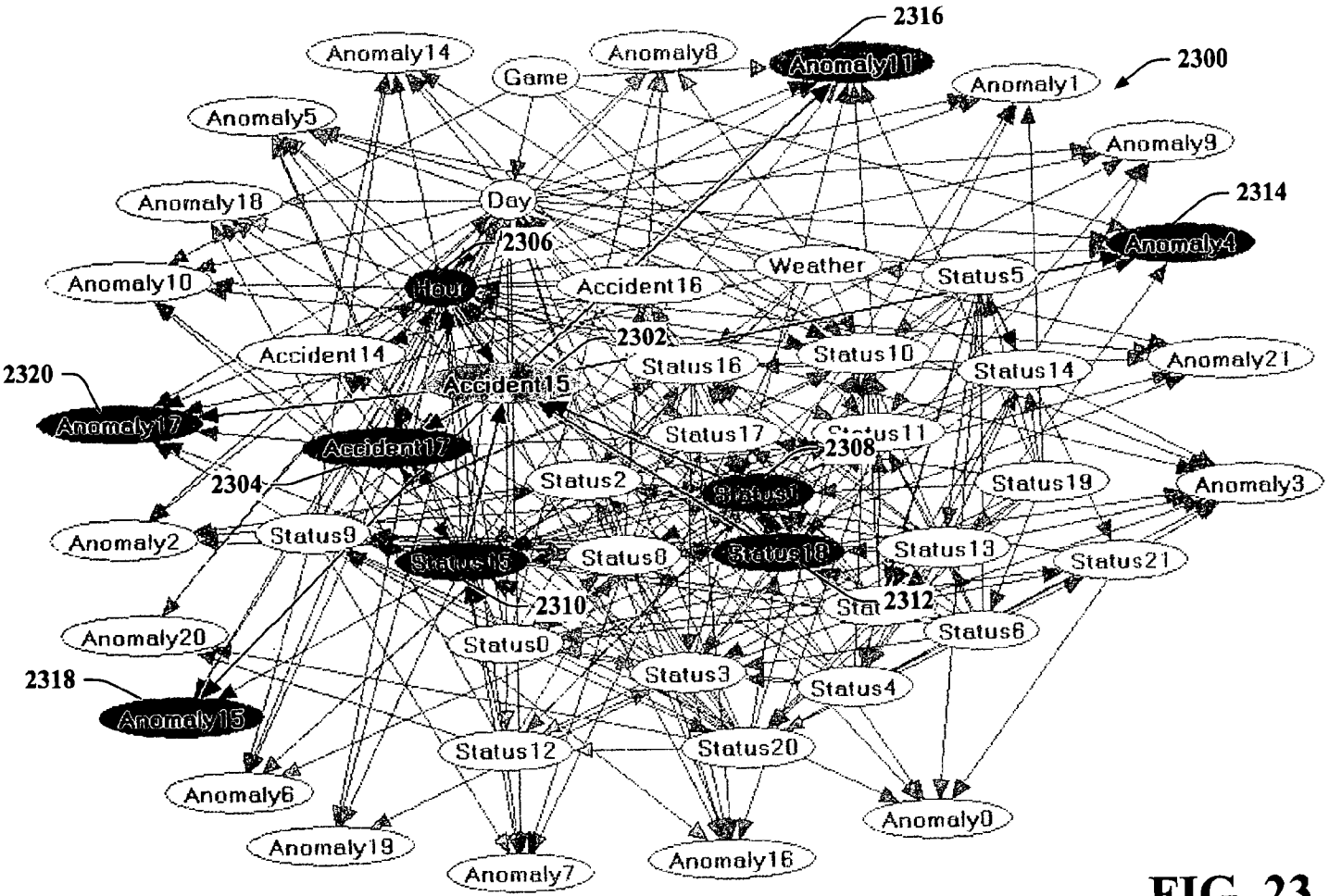
FIG. 23 is an exemplary network illustrating interdependencies between variables utilized in connection with predicting occurrences of surprising events.
Figure 24:
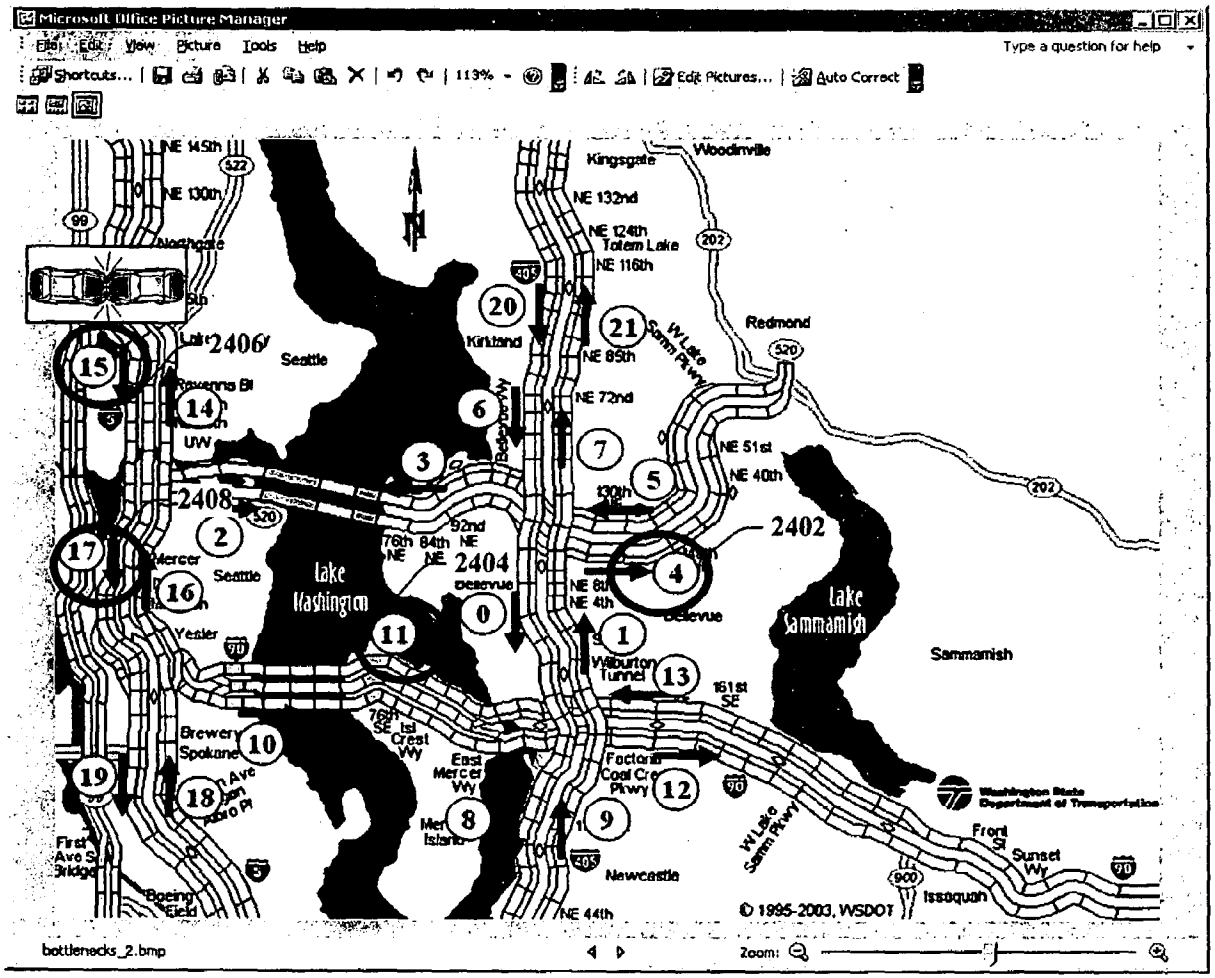
FIG. 24 is a screenshot illustrating a practical application of one or more aspects of the claimed subject matter.

Turning now to FIG. 23, another exemplary network 2300 showing learned interdependencies between variables depending upon content thereof is illustrated. In particular, the network 2300 an be a Bayesian network that can infer likelihood of states defined as surprising, atypical, and/or anomalous that will occur in a threshold time (e.g., 30 minutes). The network 2300 includes nodes 2302 and 2304, which represent occurrence of accidents at portions of a roadway (portions 15 and 17, respectively). A node 2306 represents a time of day, and nodes 2308-2312 represent traffic congestion at portions of a roadway (portions 1, 15, and 18, respectively). The aforementioned nodes 2302-2312 directly or indirectly affect nodes 2314-2320, which represent surprising traffic conditions at portions of the roadway (portions 4, 11, 15, and 17, respectively) that are predicted to occur at a particular point in time. Thus, given accidents at particular portions of a roadway and specific status of congestion at portions of a roadway, one or more surprising events can be predicted. Referring briefly to FIG. 24, a screenshot 2400 that includes circles 2402-2408 highlighting portions of the road 4, 11, 15, and 17, respectively. Such portions correspond to portions represented by the nodes 2314-2320 (FIG. 23) of the network 2300.

Figure 25:
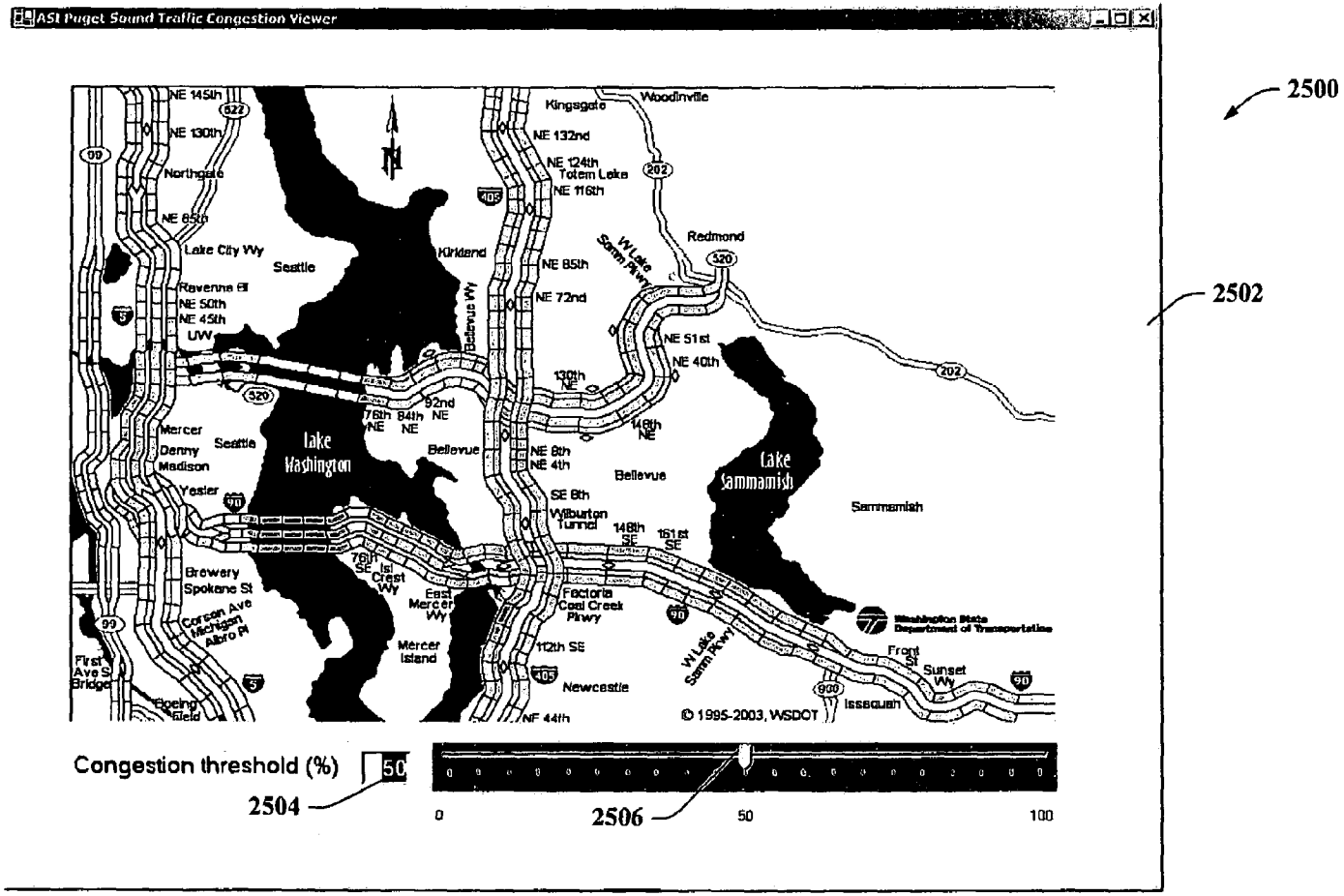
Figure 26:
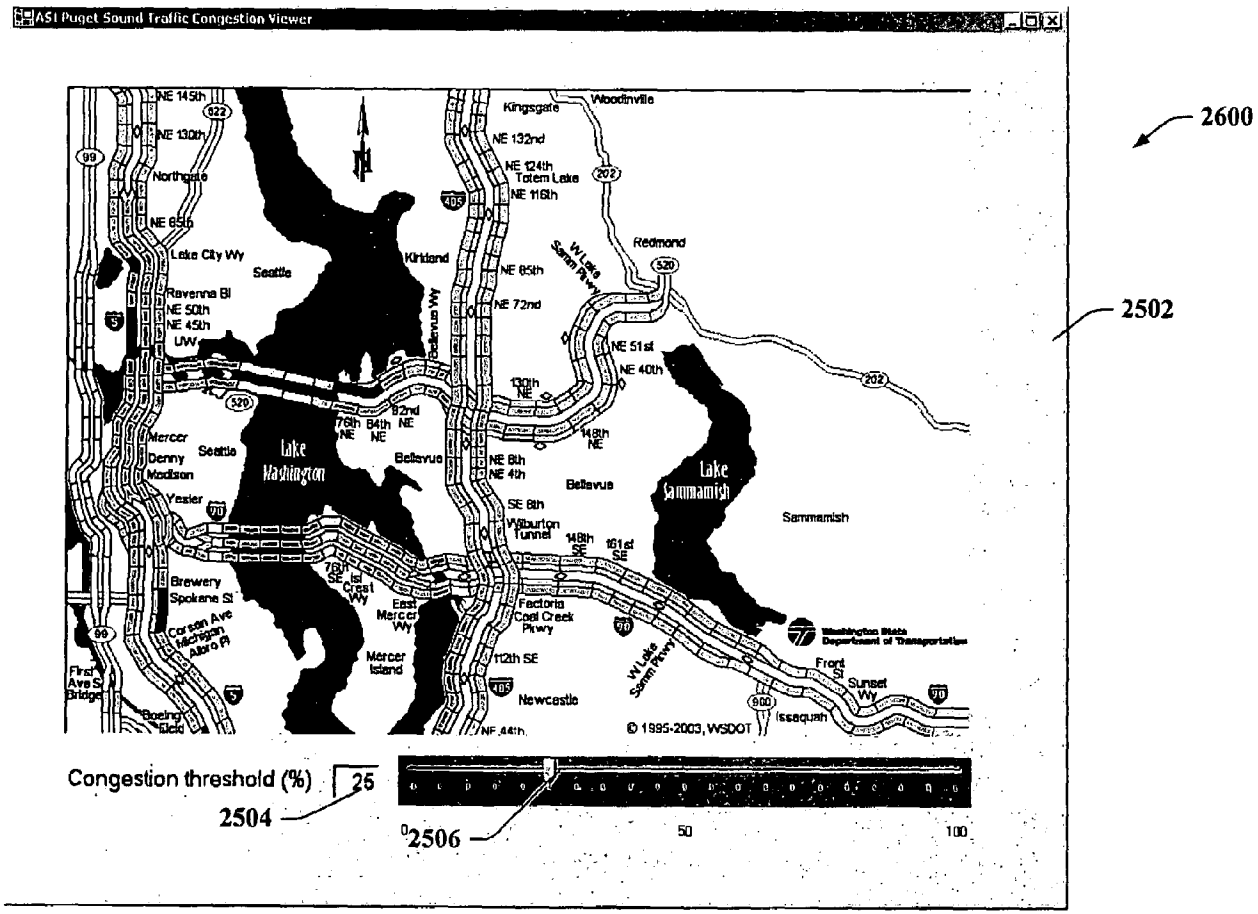
Figure 27:
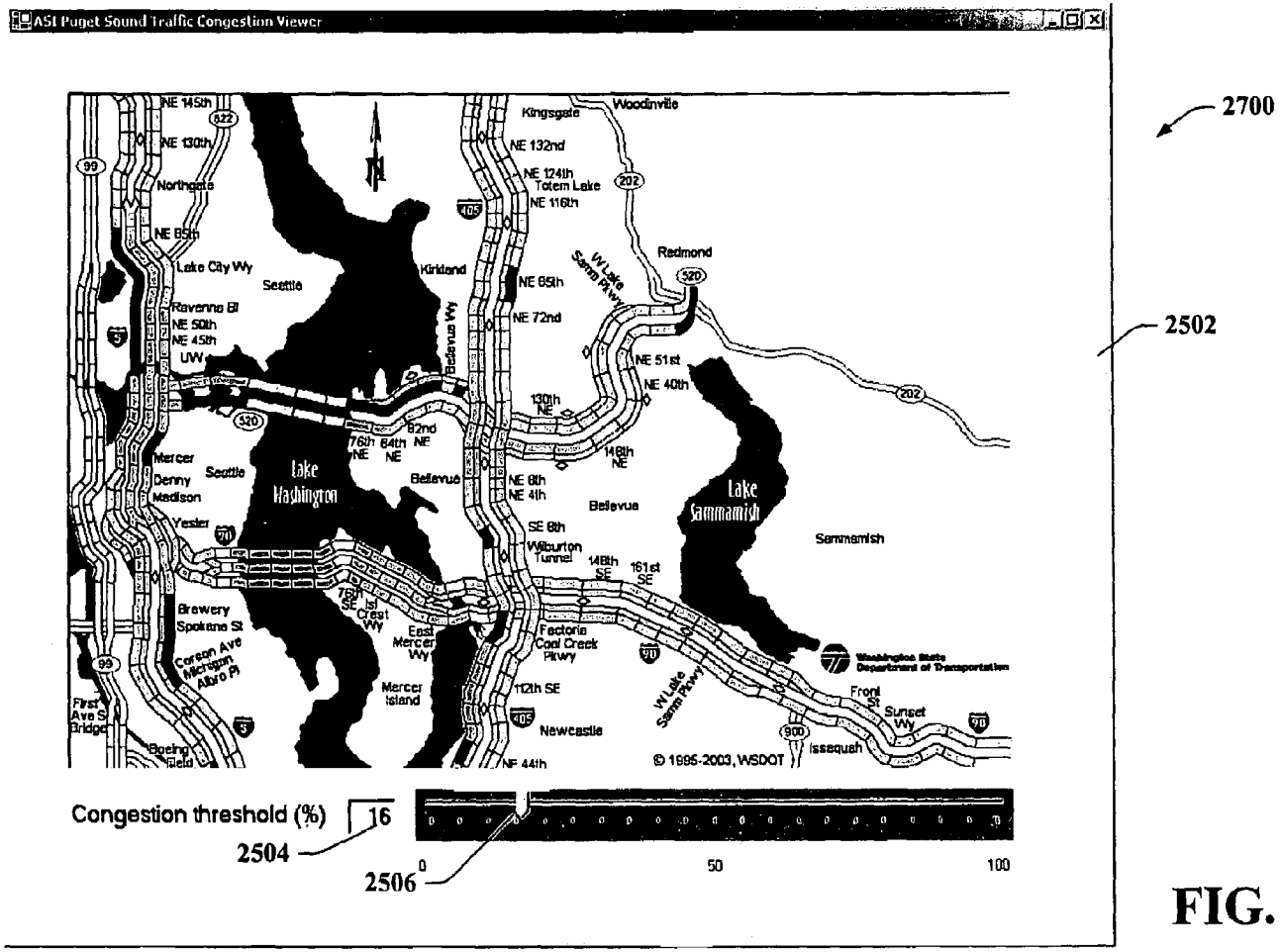
Figure 28:
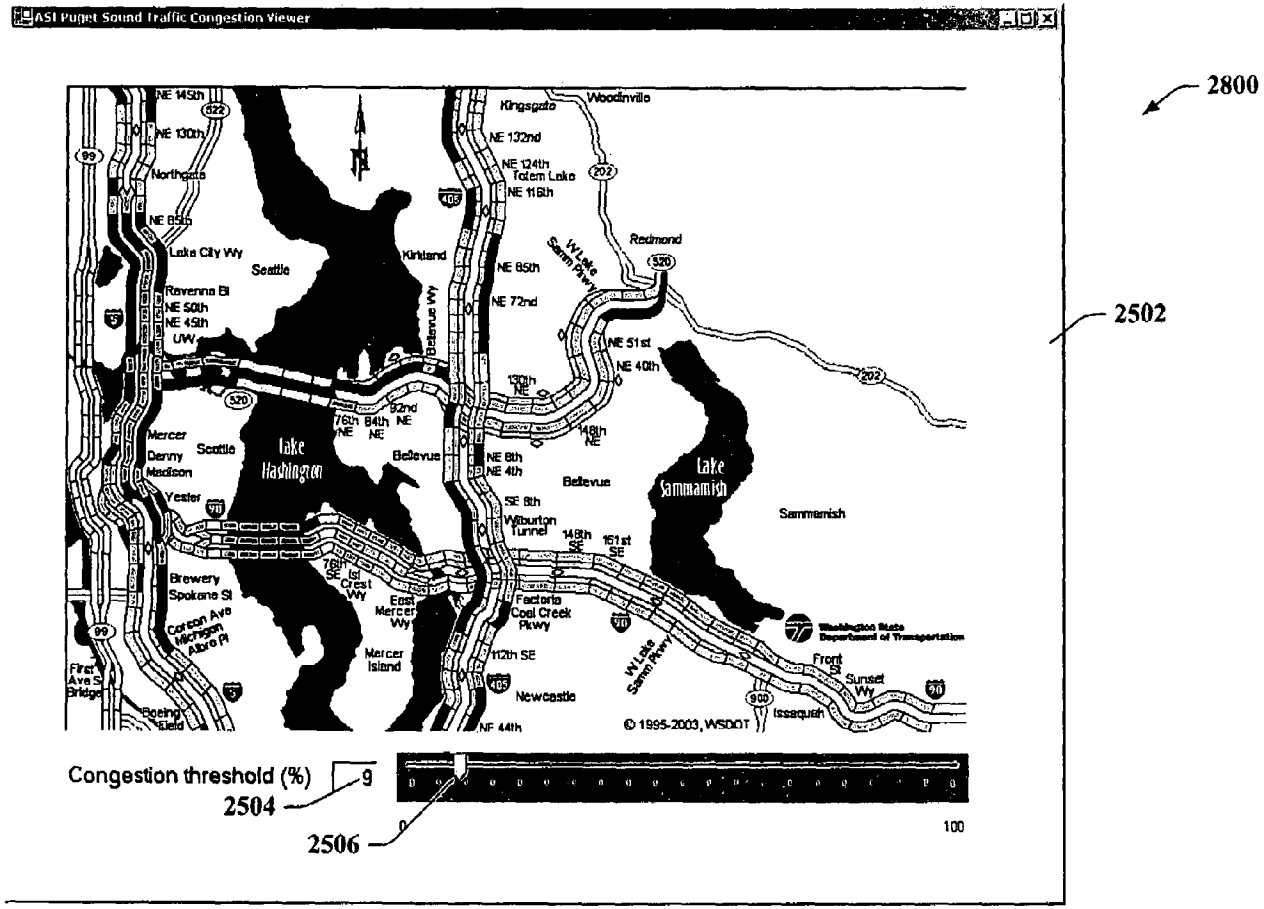

Now referring to FIGS. 25-29, screenshots 2500, 2600, 2700, 2800, and 2900 are provided that illustrate one or more aspects of the claimed subject matter. Referring first to FIG. 25, the screenshot 2500 is of a graphical user interface (or tool) 2502 that enables a user to select a threshold congestion in connection with predicting traffic patterns. A user can alter the congestion threshold by way of an editable field 2504 or by way of a sliding mechanism 2506. Thus, a predictive model can provide a user with areas where predicted threshold traffic congestion is at or above 50%. The screenshot 2500 shows that there are no portions of roadway subject to congestion at or above 50%. Furthermore, a user can select portions of roadways that are of interest to the user, and receive alerts relating to such selected portions. Thus, a user can define a route or routes of interest through the user interface 2502. Now referring to FIG. 26, a screenshot 2600 of the user interface 2502 with a congestion threshold at 25% is illustrated. The screenshot 2600 displays portions of roadway predicted to be subject to such congestion at a time specified by a user and/or automatically selected by a computing component. Turning briefly to FIG. 27, a screenshot 2700 of the user interface 2502 where a congestion threshold is chosen to be at approximately 16%. The screenshot 2700 shows that a variety of portions of roadways (being shaded more darkly than other portions of roadway) are predicted to be subject to congestion of greater than or equal to 16%. Referring now to FIG. 28, a screenshot 2800 of the user interface 2502 illustrates roadways predicted to be subject to congestion at or above a congestion threshold of 9%. Now turning to FIG. 29, a screenshot 2900 of the user interface 2502 illustrates predictions relating to traffic congestion when portions of roadways are predicted to be at or above 5%. The screenshots 2500, 2600, 2700, 2800, and 2900 thus illustrate that a user can select a level of congestion threshold for which predictions are to be made, and thereafter determine a best route to travel. For instance, a tool depicted in the screenshots 2500, 2600, 2700, 2800, and 2900 can be employed to determine portions of a road that should be focused upon with respect to generating predictions. For example, a tool can be employed to display when/where a road is congested at or above 25%, and such locations can be subject to scrutiny.

Figure 30:
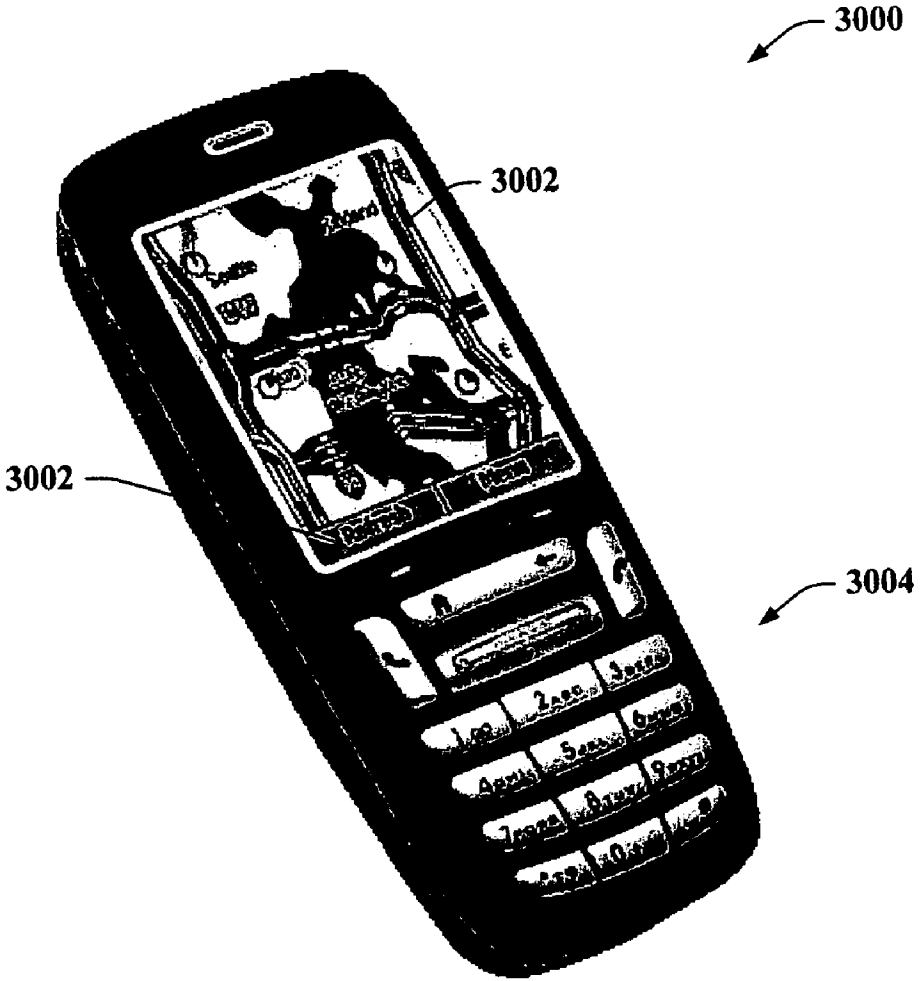
FIG. 30 is a depiction of an exemplary mobile device that can be employed in connection with one or more aspects of the claimed subject matter.

Now turning to FIG. 30, an exemplary mobile device 3000 that can be employed in connection with one or more aspects of the claimed subject matter is illustrated. The device 3000 includes a display region 3002 that graphically displays at least a portion of a roadway system and parameters relating thereto. For instance, the display region 3002 can graphically indicate that a particular portion of a roadway is subject to a certain level of traffic congestion. The mobile device 3000 can include a keypad 3004 that can be utilized to navigate through displayed indicia upon the display region 3002. Furthermore, the mobile device 3000 can include a refresh button 3006 that enables a user to refresh a graphical display according to most recent data.

Figure 31:
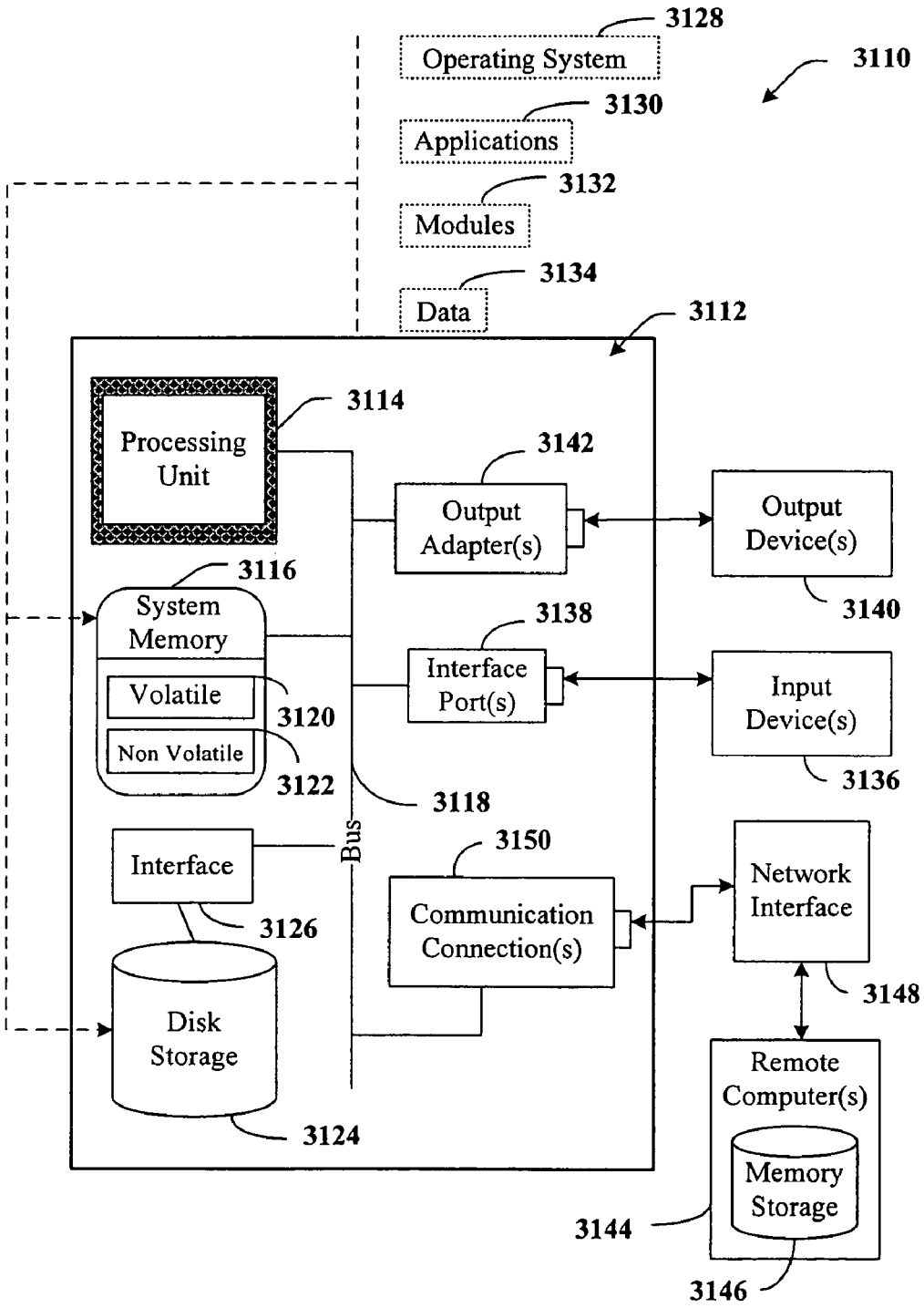
FIG. 31 is a schematic block diagram illustrating a suitable operating environment.

In order to provide additional context, FIG. 31 and the following discussion are intended to provide a brief, general description of a suitable operating environment 3110 in which various aspects described herein may be implemented. While the claimed subject matter is described in the general context of computer-executable instructions, such as program modules, executed by one or more computers or other devices, those skilled in the art will recognize that the claimed subject matter can also be implemented in combination with other program modules and/or as a combination of hardware and software.

Generally, however, program modules include routines, programs, objects, components, data structures, etc. that perform particular tasks or implement particular data types. The operating environment 3110 is only one example of a suitable operating environment and is not intended to suggest any limitation as to the scope of use or functionality of the invention. Other well known computer systems, environments, and/or configurations that may be suitable for use with the invention include but are not limited to, personal computers, hand-held or laptop devices, multiprocessor systems, microprocessor-based systems, programmable consumer electronics, network PCs, minicomputers, mainframe computers, distributed computing environments that include the above systems or devices, and the like.

With reference to FIG. 31, an exemplary environment 3110 for implementing various aspects of the invention includes a computer 3112. The computer 3112 includes a processing unit 3114, a system memory 3116, and a system bus 3118. The system bus 3118 couples system components including, but not limited to, the system memory 3116 to the processing unit 3114. The processing unit 3114 can be any of various available processors. Dual microprocessors and other multiprocessor architectures also can be employed as the processing unit 3114.

The system bus 3118 can be any of several types of bus structure(s) including the memory bus or memory controller, a peripheral bus or external bus, and/or a local bus using any variety of available bus architectures including, but not limited to, 8-bit bus, Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Universal Serial Bus (USB), Advanced Graphics Port (AGP), Personal Computer Memory Card International Association bus (PCMCIA), and Small Computer Systems Interface (SCSI).

The system memory 3116 includes volatile memory 3120 and nonvolatile memory 3122. The basic input/output system (BIOS), containing the basic routines to transfer information between elements within the computer 3112, such as during start-up, is stored in nonvolatile memory 3122. By way of illustration, and not limitation, nonvolatile memory 3122 can include read only memory (ROM), programmable ROM (PROM), electrically programmable ROM (EPROM), electrically erasable ROM (EEPROM), or flash memory. Volatile memory 3120 includes random access memory (RAM), which acts as external cache memory. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM).

Computer 3112 also includes removable/nonremovable, volatile/nonvolatile computer storage media. FIG. 31 illustrates, for example a disk storage 3124. Disk storage 3124 includes, but is not limited to, devices like a magnetic disk drive, floppy disk drive, tape drive, Jaz drive, Zip drive, LS-100 drive, flash memory card, or memory stick. In addition, disk storage 3124 can include storage media separately or in combination with other storage media including, but not limited to, an optical disk drive such as a compact disk ROM device (CD-ROM), CD recordable drive (CD-R Drive), CD rewritable drive (CD-RW Drive) or a digital versatile disk ROM drive (DVD-ROM). To facilitate connection of the disk storage devices 3124 to the system bus 3118, a removable or non-removable interface is typically used such as interface 3126.

It is to be appreciated that FIG. 31 describes software that acts as an intermediary between users and the basic computer resources described in suitable operating environment 3110. Such software includes an operating system 3128. Operating system 3128, which can be stored on disk storage 3124, acts to control and allocate resources of the computer system 3112. System applications 3130 take advantage of the management of resources by operating system 3128 through program modules 3132 and program data 3134 stored either in system memory 3116 or on disk storage 3124. It is to be appreciated that the subject invention can be implemented with various operating systems or combinations of operating systems.

A user enters commands or information into the computer 3112 through input device(s) 3136. Input devices 3136 include, but are not limited to, a pointing device such as a mouse, trackball, stylus, touch pad, keyboard, microphone, joystick, game pad, satellite dish, scanner, TV tuner card, digital camera, digital video camera, web camera, and the like. These and other input devices connect to the processing unit 3114 through the system bus 3118 via interface port(s) 3138. Interface port(s) 3138 include, for example, a serial port, a parallel port, a game port, and a universal serial bus (USB). Output device(s) 3140 use some of the same type of ports as input device(s) 3136. Thus, for example, a USB port may be used to provide input to computer 3112, and to output information from computer 3112 to an output device 3140. Output adapter 3142 is provided to illustrate that there are some output devices 3140 like monitors, speakers, and printers among other output devices 3140 that require special adapters. The output adapters 3142 include, by way of illustration and not limitation, video and sound cards that provide a means of connection between the output device 3140 and the system bus 3118. It should be noted that other devices and/or systems of devices provide both input and output capabilities such as remote computer(s) 3144.

Computer 3112 can operate in a networked environment using logical connections to one or more remote computers, such as remote computer(s) 3144. The remote computer(s) 3144 can be a personal computer, a server, a router, a network PC, a workstation, a microprocessor based appliance, a peer device or other common network node and the like, and typically includes many or all of the elements described relative to computer 3112. For purposes of brevity, only a memory storage device 3146 is illustrated with remote computer(s) 3144. Remote computer(s) 3144 is logically connected to computer 3112 through a network interface 3148 and then physically connected via communication connection 3150. Network interface 3148 encompasses communication networks such as local-area networks (LAN) and widearea networks (WAN). LAN technologies include Fiber Distributed Data Interface (FDDI), Copper Distributed Data Interface (CDDI), Ethernet/IEEE 802.3, Token Ring/IEEE 802.5 and the like. WAN technologies include, but are not limited to, point-to-point links, circuit switching networks like Integrated Services Digital Networks (ISDN) and variations thereon, packet switching networks, and Digital Subscriber Lines (DSL).

Communication connection(s) 3150 refers to the hardware/software employed to connect the network interface 3148 to the bus 3118. While communication connection 3150 is shown for illustrative clarity inside computer 3112, it can also be external to computer 3112. The hardware/software necessary for connection to the network interface 3148 includes, for exemplary purposes only, internal and external technologies such as, modems including regular telephone grade modems, cable modems and DSL modems, ISDN adapters, and Ethernet cards.

Figure 32:
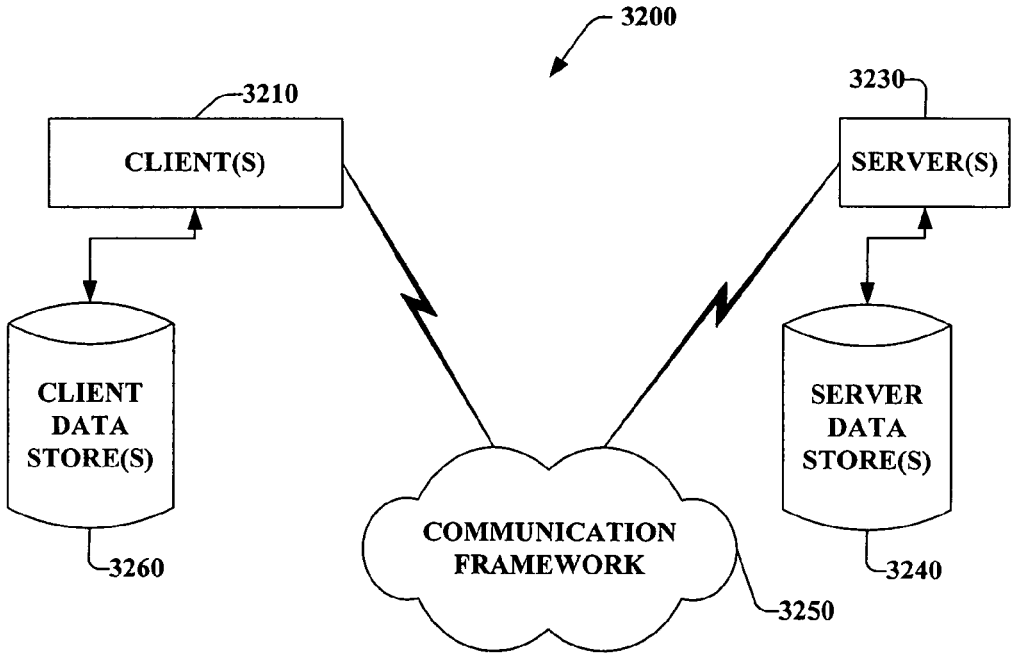
FIG. 32 is a schematic block diagram of a sample-computing environment with which the claimed subject matter.

FIG. 32 is a schematic block diagram of a sample-computing environment 3200 with which the subject invention can interact. The system 3200 includes one or more client(s) 3210. The client(s) 3210 can be hardware and/or software (e.g., threads, processes, computing devices). The system 3200 also includes one or more server(s) 3230. The server(s) 3230 can also be hardware and/or software (e.g., threads, processes, computing devices). The servers 3230 can house threads to perform transformations by employing the subject invention, for example. One possible communication between a client 3210 and a server 3230 can be in the form of a data packet adapted to be transmitted between two or more computer processes. The system 3200 includes a communication framework 3250 that can be employed to facilitate communications between the client(s) 3210 and the server(s) 3230. The client(s) 3210 are operably connected to one or more client data store(s) 3260 that can be employed to store information local to the client(s) 3210. Similarly, the server(s) 3230 are operably connected to one or more server data store(s) 3240 that can be employed to store information local to the servers 3230.

What has been described above includes examples of the claimed subject matter. It is, of course, not possible to describe every conceivable combination of components or methodologies for purposes of describing the claimed subject matter, but one of ordinary skill in the art may recognize that many further combinations and permutations are possible. Accordingly, the claimed subject matter is intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A system that facilitates communicating, visualizing, or alerting about traffic patterns, comprising:

at least one processor;

computer-executable components for execution in the at least one processor, the components comprising:

a predictive model component that generates predictions relating to traffic parameters at a future time at a location, the predictions being generated based in part on current values of context parameters other than traffic parameters, the predictions further based in part on historical data relating the context parameters to the traffic parameters at the location; and an interface component that graphically outputs traffic parameters based at least in part upon the generated predictions, the interface component:

determining a time and a location, and the traffic parameters being selectively output to the user for the determined time and for the determined location.

2. The system of claim 1, wherein the contextual parameters comprise contextual data received by way of one or more of a camera, the Internet, a television broadcast, and a radio broadcast, and the contextual data comprises at least one of time of day, day of week, holiday status, season, school status, weather properties, data relating to sporting events, data relating to parades, data relating to movies, and data relating to political events.

3. The system of claim 1, the predictive model component employs one or more of marginal or mean traffic flow expectations based on one or more of time of day, day of week, and current traffic information; and probabilistic forecasts about future traffic flows in different regions to guide creation of route plans in an attempt to minimize total driving time.

4. The system of claim 3, GPS data is utilized to locate a user and to provide information on traffic at the location.

5. The system of claim 1, the interface component existent upon one or more of a laptop, a personal digital assistant, a cellular phone, a smart phone, an automobile, and a desktop computer.

6. The system of claim 1, the predictions relating to traffic parameters at the future time are associated with one or more of time until congestions appear and time until congestions will clear at each of a set of at least one of identified trouble spots and bottleneck regions of a road system identified based on the historical data.

7. The system of claim 1, the predictive model component is built by way of a statistical method, the statistical method is one of a Bayesian network, a dynamic Bayesian network, a continuous time Bayesian network, a Hidden Markov Model, a Markov process, particle filtering, a Gibbs-sampling based approach, a neural network, a support vector machine, one or more differential equations, a logic-based reasoning system, and a fuzzy logic-centric method.

8. The system of claim 1, further comprising a model analyzer component that compares outputs predicted by the predictive model component with actual events, builds a case library of predicted situations and their accuracy, and uses the library to tune and/or annotate base level inferences so as to relay a reliability of the base level inference.

9. The system of claim 1, a case library of accuracies of predictions is used to build via statistical machine learning procedures a separate predictive model that can predict in real-time reliability of the predictive model component based at least in part on available contextual information.

10. The system of claim 1, further comprising a bottleneck identification tool that identifies regions within a traffic system associated with at least one of cyclic congestions, frequent congestions, and largest duration congestions within a traffic system via exploring statistics of congestion based on the historical data.

11. The system of claim 1, the interface component provides an input mechanism for the user to specify a congestion level and selectively outputs the traffic parameters when the predictions indicate congestion above the specified congestion level when the predicted traffic parameters indicate congestion above the threshold.

12. The system of claim 1, contextual data received and analyzed by the predictive model component utilized to improve the predictive model component.

13. A computer-readable medium comprising the computer-executable components of claim 1.

14. The system of claim 1, wherein:

the interface component comprises a control adapted to receive user input indicate of a threshold level of congestion;

at least one of the traffic parameters is a congestion parameter; and the interface component selectively outputs traffic parameters by generating an alert to the user when the congestion parameter exceeds the threshold level.

15. A computerized method for predicting traffic patterns, comprising:

generating a representation of a plurality of roadways;

determining a future time of interest to a user and a traffic pattern of interest to the user at a location of interest to the user at the future time;

with at least one processor:

predicting events with respect to traffic patterns upon the plurality of roadways at the future time at the location based at least in part on bottlenecks identified from historical data indicating a region with at least one of cyclic congestions, frequent congestions, and largest duration congestions; and selectively graphically displaying the predicted events, the selectively displaying comprising graphically displaying an indication of the traffic pattern when the predicted traffic pattern matches the traffic pattern of interest.

16. The method of claim 15, further comprising:

receiving contextual data relating to the plurality of roadways; and generating the predictions as a function of the received contextual data.

17. The method of claim 16, further comprising graphically displaying an icon that indicates at least one of a time until a region is clear and a time until an open region will jam; and graphically displaying a graphical feature to indicate occurrence of a surprising event.

18. The method of claim 15, further comprising reasoning about and among random variables that represent time until congestion and time until clear for sets of at least one of troublesome traffic hotspots and bottleneck regions in a traffic system.

19. The method of claim 15, further comprising: comparing output of the predictive model with actual events; and automatically tuning the predictive model as a function of the comparison.

20. A traffic pattern prediction system, comprising:

at least one processor;

computer-executable means executable on the at least one processor, the computer-executable means comprising:

means for predicting traffic parameters based at least on current context data;

means for determining whether the predicted traffic parameters are of interest to a user based on the predicted traffic parameters being outside a range of expected traffic parameters, the expected traffic parameters being computed based on historical data; and means for selectively alerting the user of the traffic parameters that are of interest to the user.

* * * * *